US012649615B2

(12) United States Patent
Wu

(10) Patent No.: US 12,649,615 B2
(45) Date of Patent: Jun. 9, 2026

(54) CARRIER FOR CONTAINERS

(71) Applicant: Graphic Packaging International, LLC, Atlanta, GA (US)

(72) Inventor: Meng-Chuan Wu, Norcross, GA (US)

(73) Assignee: Graphic Packaging International, LLC, Atlanta, GA (US)

( * ) Notice: Subject to any disclaimer, the term of this patent is extended or adjusted under 35 U.S.C. 154(b) by 47 days.

(21) Appl. No.: 18/388,344

(22) Filed: Nov. 9, 2023

(65) Prior Publication Data

US 2024/0158151 A1 May 16, 2024

Related U.S. Application Data

(60) Provisional application No. 63/531,426, filed on Aug. 8, 2023, provisional application No. 63/449,427, filed (Continued)

(51) Int. Cl.

| | |
|---|---|
| ***B65D 71/44*** | (2006.01) |
| ***B65B 17/02*** | (2006.01) |
| ***B65B 43/26*** | (2006.01) |

(52) U.S. Cl.

CPC ..... *B65D 71/44* (2013.01); *B65B 17/025* (2013.01); *B65B 43/265* (2013.01)

(58) Field of Classification Search

CPC ..... B65B 17/025; B65D 1/28; B65D 1/44; B65D 2571/006; B65D 71/72;

(Continued)

(56) References Cited

U.S. PATENT DOCUMENTS

| | | | |
|---|---|---|---|
| 1,527,399 | A | 2/1925 | Davidson |
| 1,925,102 | A | 9/1933 | Levkoff |

(Continued)

FOREIGN PATENT DOCUMENTS

| | | | |
|---|---|---|---|
| CA | 873185 | A1 | 6/1971 |
| DE | 196 42 571 | A1 | 5/1997 |

(Continued)

OTHER PUBLICATIONS

International Search Report and Written Opinion for PCT/US2023/037079 dated Mar. 6, 2024.

*Primary Examiner* — Anthony D Stashick
*Assistant Examiner* — Raven Collins
(74) *Attorney, Agent, or Firm* — Andrew N. Claerbout; FisherBroyles, LLP

(57) ABSTRACT

A carrier for holding a plurality of containers includes a plurality of panels including a first panel in at least partial face-to-face contact with a second panel, each of the first panel and the second panel having a first end portion, a second end portion, and a central portion including from the first end portion to the second end portion, container retention features including at least one container retention opening in each of the first panel and the second panel, the at least one container opening in the first panel aligned with the at least one container retention opening in the second panel for at least partially receiving a respective container of the plurality of containers; and a handle positioned between the first end portion and the second end portion of each of the first panel and the second panel for being grasped by a user.

40 Claims, 19 Drawing Sheets

Related U.S. Application Data on Mar. 2, 2023, provisional application No. 63/434,681, filed on Dec. 22, 2022, provisional application No. 63/424,565, filed on Nov. 11, 2022.

(58) Field of Classification Search
CPC .. B65D 71/42; B65D 71/403; B31B 2100/00; B31B 50/86; B31B 50/20
USPC ..... 206/162, 139
See application file for complete search history.

(56) References Cited

U.S. PATENT DOCUMENTS 2,005,924 A 6/1935 Wilson
2,067,749 A 1/1937 Zimmerman et al.
2,115,673 A 4/1938 Stompe
2,289,859 A 7/1942 Arthur
2,299,027 A 10/1942 Novak
2,331,038 A 10/1943 Meller
2,522,950 A 9/1950 Keith
2,669,351 A 2/1954 Carson et al.
2,694,518 A 11/1954 Zanck et al.
2,737,326 A 3/1956 Toensmeier
2,754,047 A 7/1956 Schmidt et al.
2,764,284 A 9/1956 Arneson
2,798,603 A 7/1957 Grinspoon
2,950,041 A 8/1960 Stone
2,975,934 A 3/1961 Powell
3,005,654 A 10/1961 Stone et al.
3,078,032 A 2/1963 Robinson et al.
3,128,010 A 4/1964 Forrer
3,133,634 A 5/1964 Bozdar
3,137,109 A 6/1964 Rapata
3,156,358 A 11/1964 Randrup
3,178,242 A 4/1965 Ellis et al.
3,198,378 A 8/1965 Farquhar
3,228,582 A 1/1966 Osberg
3,245,711 A 4/1966 Dantoin
3,263,861 A 8/1966 Carr
3,265,283 A 8/1966 Farquhar
3,300,115 A 1/1967 Schauer
3,332,594 A 7/1967 De Capua
3,346,167 A 10/1967 Schmidt
3,356,279 A 12/1967 Root
3,363,928 A 1/1968 Haufe et al.
3,414,313 A 12/1968 Schwarz
3,503,498 A 3/1970 Lawrence
3,517,858 A 6/1970 Farquhar
3,528,697 A 9/1970 Wood
3,533,549 A 10/1970 Gilchrist
3,540,581 A 11/1970 Koolnis
3,601,439 A 8/1971 Poupitch
3,612,266 A 10/1971 Graser
3,627,121 A 12/1971 Deasy
3,653,503 A 4/1972 Arneson
3,688,969 A 9/1972 Gaberez
3,701,416 A 10/1972 Lawrence
3,722,945 A 3/1973 Wood
3,752,305 A 8/1973 Heyne
3,767,041 A 10/1973 Graser
3,860,281 A 1/1975 Wood
3,897,873 A 8/1975 Graser
3,942,631 A 3/1976 Sutherland et al.
4,029,204 A 6/1977 Manizza
4,155,449 A 5/1979 Bryne
4,180,191 A 12/1979 Wood
4,188,766 A 2/1980 Culpepper
4,192,540 A 3/1980 Oliff
4,214,660 A 7/1980 Hunt, Jr.
4,216,861 A 8/1980 Oliff
4,222,485 A 9/1980 Focke
4,244,617 A 1/1981 Manizza
4,256,226 A 3/1981 Stone
4,304,329 A 12/1981 Graser
4,305,500 A 12/1981 Jaeschke
4,318,474 A 3/1982 Hasegawa
4,318,476 A 3/1982 Wood et al.
4,326,628 A 4/1982 Wood
4,336,898 A 6/1982 Joyce
4,364,509 A 12/1982 Holley, Jr. et al.
4,372,599 A 2/1983 Kiedaisch et al.
4,375,258 A 3/1983 Crayne et al.
4,376,509 A 3/1983 Schaffer
4,378,877 A 4/1983 Botterman et al.
4,378,878 A 4/1983 Graser
4,378,879 A 4/1983 Killy
4,382,505 A 5/1983 Sutherland et al.
4,396,143 A 8/1983 Killy
4,398,636 A 8/1983 Baxter
4,401,212 A 8/1983 Fischer
4,403,689 A 9/1983 Wood
4,417,655 A 11/1983 Forbes, Jr.
4,417,661 A 11/1983 Roccaforte
4,432,579 A 2/1984 Denmark et al.
4,438,843 A 3/1984 Graser
4,566,591 A 1/1986 Turtschan et al.
4,577,762 A 3/1986 Kuchenbecker
4,605,128 A 8/1986 Rieke
4,658,984 A 4/1987 Brunner
4,703,847 A 11/1987 Oliff
4,784,266 A 11/1988 Chaussadas
4,807,751 A 2/1989 Klygis et al.
4,817,866 A 4/1989 Wonnacott
4,890,440 A 1/1990 Romagnoli
4,949,845 A 8/1990 Dixon
4,974,771 A 12/1990 Lavery
5,101,642 A 4/1992 Alexandrov
5,103,971 A 4/1992 Schuster
5,135,104 A 8/1992 Jorba
5,137,211 A 8/1992 Summer et al.
5,139,147 A 8/1992 Sutherland
5,163,548 A 11/1992 Domansky
5,188,225 A 2/1993 Jorba
5,201,412 A 4/1993 Schuster et al.
5,219,229 A 6/1993 Sengewald
5,234,103 A 8/1993 Schuster
5,246,113 A 9/1993 Schuster
5,249,681 A 10/1993 Miller
5,267,644 A 12/1993 Tsao
5,273,156 A 12/1993 Harris
5,297,673 A 3/1994 Sutherland
5,310,050 A 5/1994 Sutherland
5,310,051 A 5/1994 Sutherland
5,318,178 A 6/1994 Davies et al.
5,323,895 A 6/1994 Sutherland et al.
5,328,024 A 7/1994 Sutherland
5,344,006 A 9/1994 Mazzeo
5,351,815 A 10/1994 Fogle et al.
5,351,816 A 10/1994 Sutherland et al.
5,351,817 A 10/1994 Sutherland
5,355,999 A 10/1994 Sutherland
5,360,104 A 11/1994 Sutherland
5,390,784 A 2/1995 Sutherland
5,407,065 A 4/1995 Sutherland
5,415,278 A 5/1995 Sutherland
5,425,474 A 6/1995 Dalea et al.
5,443,153 A 8/1995 Sutherland
5,445,262 A 8/1995 Sutherland
5,452,799 A 9/1995 Sutherland
5,476,170 A 12/1995 Weber
5,482,185 A 1/1996 McNaughton
5,484,053 A * 1/1996 Harris ..... B65D 71/48 206/149
5,484,059 A 1/1996 Sutherland
5,503,267 A 4/1996 Sutherland
5,505,304 A 4/1996 Broskow et al.
5,505,372 A 4/1996 Edson et al.
5,520,283 A 5/1996 Sutherland
5,524,756 A 6/1996 Sutherland
5,551,566 A 9/1996 Sutherland
5,553,705 A 9/1996 Bakx
5,577,612 A 11/1996 Chesson et al.
5,593,027 A 1/1997 Sutherland
5,597,114 A 1/1997 Kramedjian et al.
5,598,920 A 2/1997 Hansen

(56) References Cited

U.S. PATENT DOCUMENTS 5,620,094 A 4/1997 Naumann
5,622,309 A 4/1997 Matsuda et al.
5,638,956 A 6/1997 Sutherland
5,664,683 A 9/1997 Brody
5,667,070 A 9/1997 Miret
5,687,838 A 11/1997 Bakx
5,690,213 A 11/1997 Matsumura
5,690,230 A 11/1997 Griffith
5,706,936 A 1/1998 Bernstein
5,711,419 A 1/1998 Beales et al.
5,738,217 A 4/1998 Hunter
5,746,310 A 5/1998 Slomski
5,791,463 A 8/1998 Negelen
5,794,778 A 8/1998 Harris
5,816,391 A * 10/1998 Harris ..... B65D 71/44 206/427
5,820,185 A 10/1998 Gomes
5,826,783 A 10/1998 Stout
5,845,776 A 12/1998 Galbierz et al.
5,875,961 A 3/1999 Stone et al.
5,878,876 A 3/1999 Galbierz et al.
5,881,884 A 3/1999 Podosek
5,921,392 A 7/1999 Davis
5,921,398 A 7/1999 Carroll
5,924,559 A 7/1999 Carrel et al.
5,927,498 A 7/1999 Saam
5,960,945 A 10/1999 Sutherland
5,979,747 A 11/1999 Gnadt et al.
5,984,086 A 11/1999 Foushee et al.
D420,575 S 2/2000 Rovere
6,021,897 A 2/2000 Sutherland
6,039,181 A 3/2000 Whiteside
6,050,402 A 4/2000 Walter
6,059,099 A 5/2000 Galbierz
6,176,419 B1 1/2001 Holley, Jr.
6,223,891 B1 5/2001 Devens et al.
6,223,892 B1 5/2001 Bakx
6,241,083 B1 6/2001 Harrelson
6,283,293 B1 9/2001 Lingamfelter
6,293,392 B1 9/2001 Galbierz
6,315,111 B1 11/2001 Sutherland
6,394,272 B1 5/2002 Domansky
6,409,077 B1 6/2002 Telesca et al.
D459,927 S 7/2002 Flowers et al.
6,478,219 B1 11/2002 Holley, Jr.
6,484,903 B2 11/2002 Spivey et al.
6,488,322 B2 12/2002 Bakx
6,550,615 B2 4/2003 Lingamfelter
6,557,699 B1 5/2003 Focke et al.
6,578,736 B2 6/2003 Spivey
6,604,677 B1 8/2003 Sutherland et al.
6,615,984 B2 9/2003 Saulas et al.
6,669,083 B2 12/2003 Bates
6,715,639 B2 4/2004 Spivey
6,752,262 B1 6/2004 Boriani et al.
6,789,673 B2 9/2004 Lingamfelter
6,866,188 B2 3/2005 Harrelson
6,896,130 B2 5/2005 Theelen
6,902,104 B2 6/2005 Holley, Jr. et al.
6,918,487 B2 7/2005 Harrelson
6,929,172 B2 8/2005 Bates et al.
6,945,450 B2 9/2005 Rusnock
6,968,992 B2 11/2005 Schuster
6,969,172 B2 11/2005 Actis-Datta
6,974,072 B2 12/2005 Harrelson
6,991,107 B2 1/2006 Harrelson
6,997,316 B2 2/2006 Sutherland
7,000,803 B2 2/2006 Miller
7,011,209 B2 3/2006 Sutherland et al.
7,083,046 B2 8/2006 Bakx
7,104,435 B2 9/2006 Holley, Jr.
7,134,593 B2 11/2006 Harrelson
7,163,103 B2 1/2007 Bakx et al.
7,168,558 B2 1/2007 Harrelson
7,225,930 B2 6/2007 Ford et al.
7,240,789 B2 7/2007 Sutherland
7,264,114 B2 9/2007 Daniel
7,374,038 B2 5/2008 Smalley
7,690,507 B2 4/2010 Sutherland
7,721,878 B2 5/2010 Requena
7,789,231 B2 9/2010 Requena
7,823,721 B2 11/2010 Sutherland
8,056,709 B2 11/2011 Sutherland
8,096,413 B2 1/2012 DePaula
8,162,135 B2 4/2012 Oliveira
8,256,617 B2 9/2012 Gomes et al.
8,348,142 B2 1/2013 Smalley
8,469,184 B2 6/2013 Spivey, Sr.
11,014,727 B2 5/2021 McCree et al.
11,027,904 B2 6/2021 McCree et al.
11,027,905 B2 6/2021 Ford
11,180,301 B2 11/2021 Smalley
D944,656 S 3/2022 Spivey, Sr.
D946,416 S 3/2022 Smalley
D946,417 S 3/2022 Manzano et al.
D946,418 S 3/2022 Manzano et al.
D946,419 S 3/2022 Manzano et al.
D946,420 S 3/2022 Manzano et al.
D946,421 S 3/2022 Manzano et al.
11,261,013 B2 3/2022 Smalley
11,286,094 B2 3/2022 Manzano et al.
11,492,185 B2 11/2022 Zammit et al.
D974,923 S 1/2023 Smalley
D983,049 S 4/2023 McCree et al.
D984,266 S 4/2023 McCree et al.
D984,279 S 4/2023 McCree et al.
D984,280 S 4/2023 McCree et al.
D984,282 S 4/2023 McCree et al.
11,623,803 B2 4/2023 Thompson et al.
11,628,994 B2 4/2023 McCree et al.
D996,227 S 8/2023 L'Heureux et al.
D1,000,290 S 10/2023 Thompson et al.
11,840,387 B2 12/2023 Thompson
11,958,673 B2 4/2024 Thompson et al.
12,037,173 B2 7/2024 Smalley
12,071,291 B2 8/2024 Ford
12,103,751 B2 10/2024 Hicks et al.
12,172,780 B2 12/2024 Ford et al.
12,195,256 B2 1/2025 Ford
D1,063,642 S 2/2025 Hicks et al.
D1,063,643 S 2/2025 Holley et al.
D1,063,644 S 2/2025 Holley et al.
D1,064,845 S 3/2025 Ford
D1,064,846 S 3/2025 Ford
D1,064,847 S 3/2025 Thompson
D1,064,848 S 3/2025 Thompson
2002/0029991 A1 3/2002 Lingamfelter
2002/0070139 A1 6/2002 Bates
2002/0088820 A1 7/2002 Spivey
2002/0088821 A1 7/2002 Spivey et al.
2002/0185499 A1 12/2002 Harrelson et al.
2002/0195371 A1 12/2002 Brown
2003/0080004 A1 5/2003 Olsen et al.
2003/0141313 A1 7/2003 Bates
2003/0150759 A1 8/2003 White, Jr.
2003/0192907 A1 10/2003 Bates
2003/0213705 A1 11/2003 Woog
2004/0011674 A1 1/2004 Theelen
2004/0060972 A1 4/2004 Harrelson
2004/0079666 A1 4/2004 Bakx
2004/0089575 A1 5/2004 Lingamfelter
2004/0089671 A1 5/2004 Miller
2004/0099558 A1 5/2004 Oliff et al.
2004/0155098 A1 8/2004 Harrelson
2004/0188277 A1 9/2004 Auclair
2004/0188300 A1 9/2004 Sutherland
2004/0226833 A1 11/2004 Daniel
2005/0023170 A1 2/2005 Lingamfelter
2005/0092820 A1 5/2005 Chekroune
2005/0103650 A1 5/2005 Auclair et al.
2005/0126947 A1 6/2005 Holley
2005/0127151 A1 6/2005 Johnson
2005/0178791 A1 8/2005 Miller
2005/0189405 A1 9/2005 Gomes et al.

(56) References Cited

U.S. PATENT DOCUMENTS

| | | | | |
|---|---|---|---|---|
| 2005/0224565 | A1 | 10/2005 | Holley | |
| 2006/0054522 | A1 | 3/2006 | Kline et al. | |
| 2006/0091193 | A1 | 5/2006 | DeBusk | |
| 2006/0118606 | A1 | 6/2006 | Holley, Jr. et al. | |
| 2006/0131370 | A1 | 6/2006 | Bates | |
| 2006/0175386 | A1 | 8/2006 | Holley, Jr. | |
| 2008/0121536 | A1 | 5/2008 | Miret | |
| 2008/0135423 | A1 | 6/2008 | Oliveira | |
| 2009/0101526 | A1 | 4/2009 | Sutherland et al. | |
| 2009/0127147 | A1 | 5/2009 | Sutherland | |
| 2009/0242445 | A1 | 10/2009 | Gomes et al. | |
| 2010/0264043 | A1 | 10/2010 | De Paula | |
| 2011/0000799 | A1 | 1/2011 | Gonzalez | |
| 2011/0284623 | A1 | 11/2011 | Jones et al. | |
| 2012/0080328 | A1 | 4/2012 | DePaula | |
| 2012/0138489 | A1 | 6/2012 | Holley, Jr. | |
| 2012/0285854 | A1 | 11/2012 | Spivey, Sr. | |
| 2013/0126366 | A1* | 5/2013 | Smalley | B65D 71/44 206/162 |
| 2022/0097941 | A1* | 3/2022 | McCree | B65D 71/42 |

FOREIGN PATENT DOCUMENTS

| | | | |
|---|---|---|---|
| DE | 202 13 450 | U1 | 11/2002 |
| DE | 203 17 334 | U1 | 2/2004 |
| DE | 20 2004 004 248 | U1 | 8/2004 |
| DE | 20 2004 017 954 | U1 | 2/2005 |
| EP | 0 048 506 | | 3/1982 |
| EP | 0 285 043 | A1 | 10/1988 |
| EP | 0 398 835 | B1 | 11/1990 |
| EP | 0 495 197 | A1 | 7/1992 |
| EP | 0 066 029 | A1 | 12/1992 |
| EP | 0 541 334 | A1 | 5/1993 |
| EP | 0 636 554 | A2 | 2/1995 |
| EP | 0 780 320 | A1 | 6/1997 |
| EP | 0 806 372 | | 6/1997 |
| EP | 1 070 671 | A1 | 1/2001 |
| EP | 1 384 679 | | 1/2004 |
| FR | 1 582 235 | | 9/1969 |
| FR | 2 525 992 | | 11/1983 |
| FR | 2 549 010 | | 1/1985 |
| FR | 2 664 239 | | 1/1992 |
| FR | 2 731 413 | | 9/1996 |
| GB | 1 342 180 | | 12/1973 |
| GB | 2 085 391 | A | 4/1982 |
| GB | 2 158 037 | A | 11/1985 |
| GB | 2 264 101 | A | 8/1993 |
| JP | 2003-146359 | | 5/2003 |
| KR | 10-2005-0051616 | A | 6/2005 |
| KR | 10-217716 | B1 | 11/2020 |
| WO | WO 93/25439 | A1 | 12/1993 |
| WO | WO 96/29260 | | 9/1996 |
| WO | WO 97/33807 | | 9/1997 |
| WO | WO 98/49071 | A1 | 11/1998 |
| WO | WO 99/01356 | | 1/1999 |
| WO | WO 99/64301 | | 12/1999 |
| WO | WO 00/03937 | | 1/2000 |
| WO | WO 02/47990 | A2 | 6/2002 |
| WO | WO 02/059011 | A2 | 8/2002 |
| WO | WO 02/062676 | A1 | 8/2002 |
| WO | WO 02/079048 | A1 | 10/2002 |
| WO | WO 03/016167 | A1 | 2/2003 |
| WO | WO 2004/043790 | A2 | 5/2004 |
| WO | WO 2005/051781 | A1 | 6/2005 |
| WO | WO 2005/095222 | A1 | 10/2005 |
| WO | WO 2006/044583 | A2 | 4/2006 |
| WO | WO 2006/050210 | A2 | 5/2006 |
| WO | WO 2006/050316 | A1 | 5/2006 |
| WO | WO 2006/108098 | A1 | 10/2006 |
| WO | WO 2007/044525 | A1 | 4/2007 |
| WO | WO 2007/089844 | A1 | 8/2007 |

* cited by examiner

CARRIER FOR CONTAINERS

CROSS-REFERENCE TO RELATED APPLICATIONS

This application claims the benefit of each of U.S. Provisional Patent Application No. 63/424,565, filed on Nov. 11, 2022, U.S. Provisional Patent Application No. 63/434,681, filed on Dec. 22, 2022, and U.S. Provisional Patent Application No. 63/449,427, filed on Mar. 2, 2023, and U.S. Provisional Patent Application No. 63/531,426, filed on Aug. 8, 2023.

INCORPORATION BY REFERENCE

The disclosures of each of U.S. Provisional Patent Application No. 63/424,565, filed on Nov. 11, 2022, U.S. Provisional Patent Application No. 63/434,681, filed on Dec. 22, 2022, and U.S. Provisional Patent Application No. 63/449,427, filed on Mar. 2, 2023, U.S. Provisional Patent Application No. 63/531,426, filed on Aug. 8, 2023, and U.S. Design patent application No. 29/906,757, filed on Nov. 9, 2023, are hereby incorporated by reference for all purposes as if set for in their entirety.

BACKGROUND OF THE DISCLOSURE

The present disclosure generally relates to cartons or carriers for holding, displaying, and/or transporting containers.

SUMMARY OF THE DISCLOSURE

According to one aspect, the disclosure is generally directed to a carrier for holding a plurality of containers, the carrier comprising a plurality of panels comprising a first panel in at least partial face-to-face contact with a second panel, each of the first panel and the second panel comprising a first end portion, a second end portion, and a central portion extending from the first end portion to the second end portion, container retention features comprising at least one container retention opening in each of the first panel and the second panel, the at least one container opening in the first panel aligned with the at least one container retention opening in the second panel for at least partially receiving a respective container of the plurality of containers, and a handle positioned between the first end portion and the second end portion of each of the first panel and the second panel for being grasped by a user.

According to another aspect, the disclosure is generally directed to a blank for forming a carrier for holding a plurality of containers comprises a plurality of panels comprising a first panel for being positioned in at least partial face-to-face contact with a second panel when the carrier is formed from the blank, each of the first panel and the second panel comprising a first end portion, a second end portion, and a central portion extending from the first end portion to the second end portion, container retention features comprising at least one container retention opening in each of the first panel and the second panel, the at least one container opening in the first panel for being aligned with the at least one container retention opening in the second panel for at least partially receiving a respective container of the plurality of containers when the carrier is formed from the blank, and a handle portion positioned between the first end portion and the second end portion of each of the first panel and the second panel for forming a handle for being grasped by a user when the carrier is formed from the blank.

According to another aspect, the disclosure is generally directed to a method of forming a carrier for holding a plurality of containers, the method comprising obtaining a blank, the blank comprising a plurality of panels comprising a first panel and a second panel, each of the first panel and the second panel comprising a first end portion, a second end portion, and a central portion extending from the first end portion to the second end portion, container retention features comprising at least one container retention opening in each of the first panel and the second panel, and a handle portion positioned between the first end portion and the second end portion of each of the first panel and the second panel. The method further comprises folding the plurality of panels such that the first panel is positioned in at least partial face-to-face contact with the second panel, aligning the at least one container opening in the first panel with the at least one container retention opening in the second panel for at least partially receiving a respective container of the plurality of containers, and positioning the handle portion of each of the first panel and the second panel to form a handle.

According to another aspect, the disclosure is generally directed to a package, the package comprising a plurality of containers and a carrier holding the plurality of containers. The carrier comprises a plurality of panels comprising a first panel in at least partial face-to-face contact with a second panel, each of the first panel and the second panel comprising a first end portion, a second end portion, and a central portion extending from the first end portion to the second end portion, container retention features comprising at least one container retention opening in each of the first panel and the second panel, the at least one container opening in the first panel aligned with the at least one container retention opening in the second panel and at least partially receiving a respective container of the plurality of containers, and a handle positioned between the first end portion and the second end portion of each of the first panel and the second panel for being grasped by a user.

Those skilled in the art will appreciate the above stated advantages and other advantages and benefits of various additional embodiments reading the following detailed description of the embodiments with reference to the below-listed drawing figures. It is within the scope of the present disclosure that the above-discussed aspects be provided both individually and in various combinations.

BRIEF DESCRIPTION OF THE DRAWINGS

According to common practice, the various features of the drawings discussed below are not necessarily drawn to scale. Dimensions of various features and elements in the drawings may be expanded or reduced to more clearly illustrate the embodiments of the disclosure.

Corresponding parts are designated by corresponding reference numbers throughout the drawings.

DETAILED DESCRIPTION

The present disclosure generally relates to carriers, packages, constructs, sleeves, cartons, or the like, for holding and displaying containers such as jars, bottles, cans, etc. The containers can be used for packaging food and beverage products, for example. The containers can be made from materials suitable in composition for packaging the particular food or beverage item, and the materials include, but are not limited to, glass; plastics such as PET, LDPE, LLDPE, HDPE, PP, PS, PVC, EVOH, and Nylon; and the like; aluminum and/or other metals; or any combination thereof.

Carriers according to the present disclosure can accommodate containers of numerous different shapes. For the purpose of illustration and not for the purpose of limiting the scope of the disclosure, the following detailed description describes food or beverage containers which can include, but are not limited to, generally cylindrical containers such as aluminum cans, glass or polymer (such as plastic) bottles with upper narrowing neck portions, which can be those of a type available to hold and/or dispense beverages, condiments, dressings, etc. In this specification, the terms "lower," "bottom," "upper" and "top" indicate orientations determined in relation to fully erected carriers.

Figure 1:
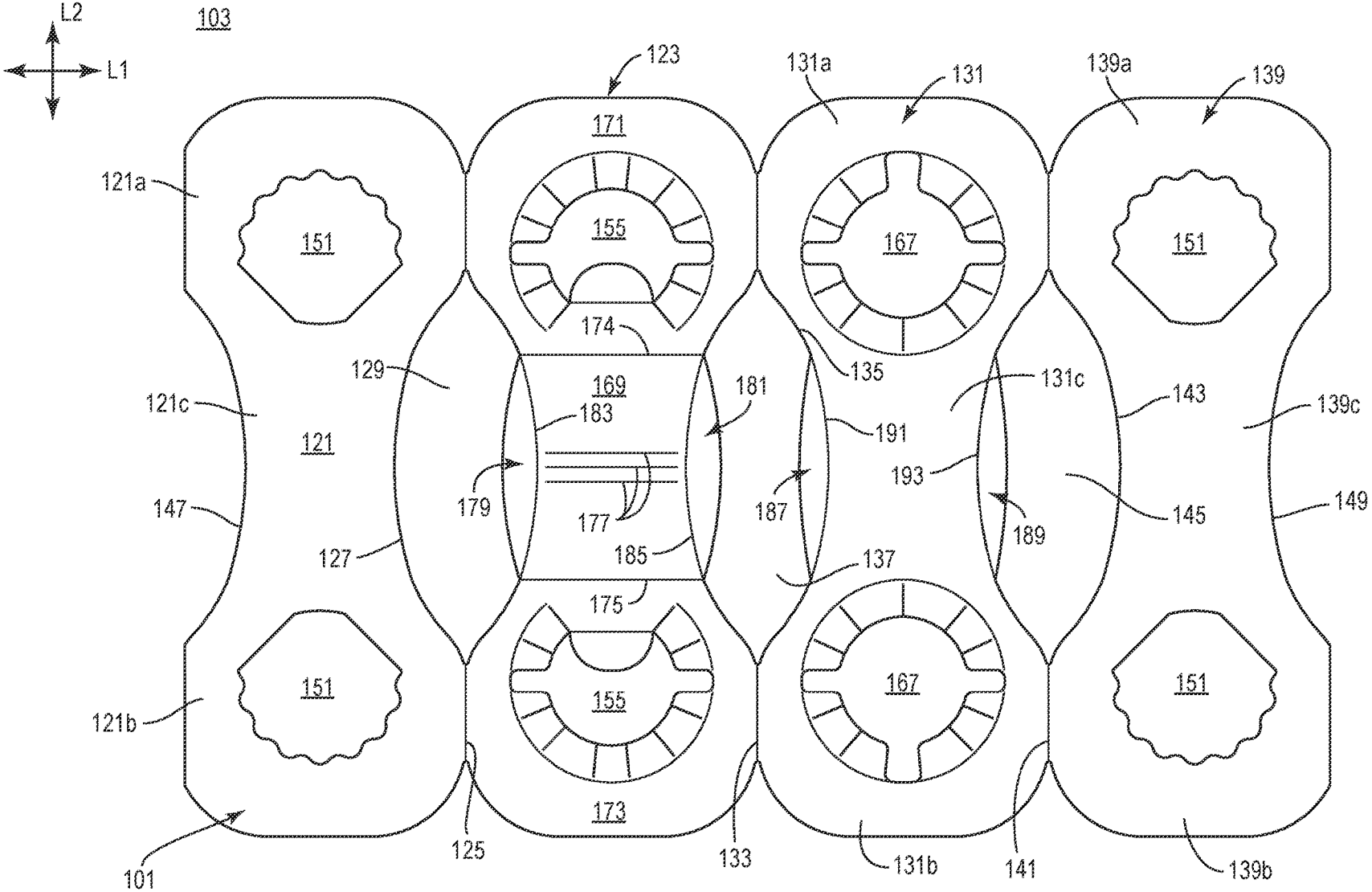
FIG. 1 is a plan view of an exterior surface of a blank for forming a carrier for containers according to a first exemplary embodiment of the disclosure.
Figure 1A:
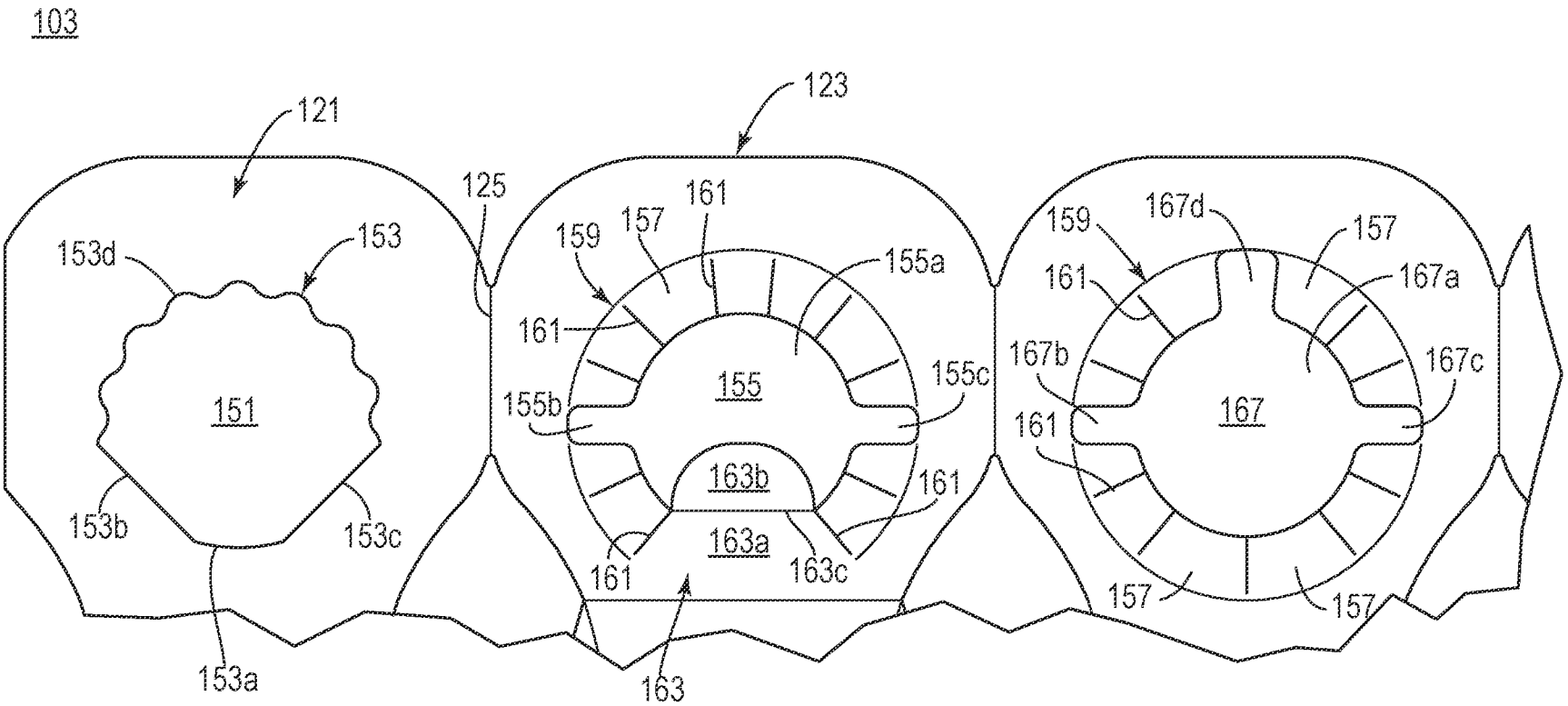
FIG. 1A is an enlarged view of a portion of the blank of FIG. 1.

FIG. 1 is a plan view of an exterior surface 101 of a blank 103 for forming a carrier 105 (FIG. 2) according to a first exemplary embodiment of the disclosure. FIG. 1A is an enlarged view of a portion of the blank 103. As described further herein, the carrier 105 can be configured for holding/supporting/retaining/receiving a plurality of containers.

Figure 3:
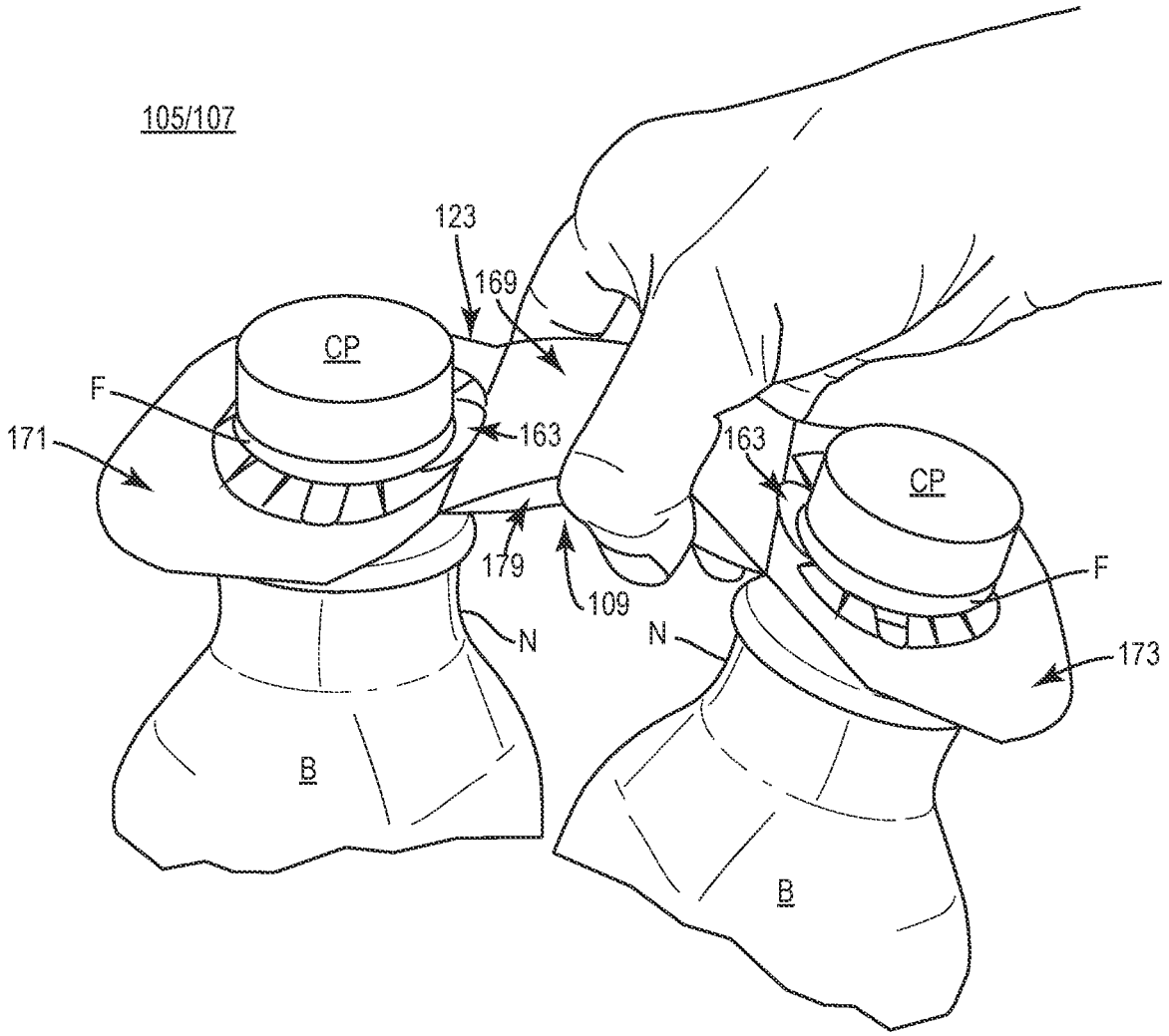
FIG. 3 is a perspective view of the carrier of FIG. 2 being lifted by a user.

As shown in FIG. 3, the carrier 105 is sized to contain or support two containers B. In the illustrated embodiment, the containers B can be bottles, e.g., plastic bottles formed of polyethylene terephthalate (PET) or another polymer, and having upper portions that include an at least partially tapered neck portion N intersecting a flange F that at least partially supports a cap CP. In other embodiments, the containers B could be beverage cans or another suitable type and size of container. The carrier 105 can be provided together with one or more of the containers B as a package 107.

Still referring to FIGS. 1 and 1A, the blank 103 has a longitudinal axis L1 and a lateral axis L2. In one embodiment, the axis L1 can be a lateral axis and the axis L2 can be a longitudinal axis.

In the illustrated embodiment, the blank 103 includes a plurality of panels that include a first top panel or first attachment panel or first panel 121 foldably connected to a second top panel or second attachment panel or second panel 123 at a lateral fold line 125 interrupted by a generally ovoid cut 127 that defines a generally ovoid first opening 129. A third top panel or third attachment panel or third panel 131 can be foldably connected to the second panel 123 at a lateral fold line 133 that is interrupted by a generally ovoid cut 135 that defines a generally ovoid opening 137. A fourth top panel or fourth attachment panel or fourth panel 139 can be foldably connected to the third panel 131 at a lateral fold line 141 that is interrupted by a generally ovoid cut 143 that defines a generally ovoid second opening 145.

Generally curved cuts 147, 149 can also be at least partially defined along free edge portions of the panels 121, 139 such that the arrangement of cuts 127, 135, 143, 147, 149 forms the plurality of panels 121, 123, 131, 139 having respective generally tapering/narrower central portions in the lateral direction, and respective lateral end portions wider than the respective central portions.

In this regard, the panel 121 can include a pair of laterally opposed end portions 121*a*, 121*b*, (broadly, "first end portion" and "second end portion", respectively) and a relatively tapered/narrower central portion 121*c* extending from the portion 121*a* to the portion 121*b*. Similarly, the panel 131 can include a pair of laterally opposed end portions 131*a*, 131*b* (broadly, "first end portion" and "second end portion", respectively), and a relatively tapered/narrower central portion 131*c* extending from the portion 131*a* to the portion 131*b*. The panel 139 can include a pair of laterally opposed end portions 139*a*, 139*b* (broadly, "first end portion" and "second end portion", respectively) and a relatively tapered/narrower central portion 139*c* extending from the portion 139*a* to the portion 139*b*.

As described further herein, the second panel 123 can include a pair of laterally opposed end portions 171, 173 (broadly, "first end portion" and "second end portion", respectively) and a central or handle portion 169 foldably connected to the respective end portions 171, 173 at respective longitudinal fold lines 174, 175 so as to extend from the end portion 171, 173.

It will be understood that one or more of the panels of the blank 103 and carrier 105 formed therefrom can have a different configuration and/or arrangement without departing from the disclosure.

The blank 103 and carrier 105 formed therefrom can include a plurality of container retention features for at least partially receiving one or more containers of the plurality of containers B. In the illustrated embodiment, a pair of container retention openings 151 (broadly respective "first container retention opening" and "second container retention opening") can be at least partially defined in laterally opposed portions of the first panel 121 and for at least partially receiving a respective container of the plurality of containers B when the carrier 105 is formed from the blank 103, as described further herein.

Each container retention opening 151, as shown, can be at least partially defined by a respective cut 153 having a generally longitudinal or generally curved segment 153*a*, a pair of generally oblique segments 153*b*, 153*c* extending from respective endpoints of the segment 153*a*, and a generally sinusoidally curved segment 153*d* extending from an endpoint of the segment 153*b* to an endpoint of the segment 153*c*.

A pair of laterally opposed container retention openings 155 (broadly respective "first container retention opening" and "second container retention opening") can also be defined in the second panel 123, each configured for receiving a portion of a respective container of the plurality of containers B when the carrier 105 is formed from the blank 103, as described further herein. Each opening 155 can include a central portion 155*a* and a pair of longitudinally extending portions 155*b*, 155*c* extending in opposite directions from the central portion 155*a*. A plurality of container retention tabs 157 can be generally circumferentially arranged about and extending into the respective openings 155, with respective container retention tabs 157 foldably connected to the second panel 123 at respective portions of a generally curved fold line 159 that is interrupted by respective portions 155*b*, 155*c* of the respective openings 155. As also shown, respective adjacent container retention tabs 157 can be at least partially separable from one another at respective oblique cuts 161.

A container retention tab 163, generally larger than the respective container retention tabs 157, can also be positioned extending into the respective openings 155. In the illustrated embodiment, the container retention tabs 163 can have a respective base portion 163*a* that is generally uninterrupted from respective portions of the panel 123 from which they extend, and a respective distal portion 163*b* foldably connected to the respective base portion 163*a* at a respective longitudinal fold line 163*c* and positioned extending generally further into the respective opening 155 than the respective container retention tabs 157.

A pair of laterally opposed container retention openings 167 can be at least partially defined in the third panel 131, each opening 167 configured to at least partially receive a portion of a respective container of the plurality of containers B when the carrier 105 is formed from the blank 103, as described further herein. As shown, respective pluralities of the container retention tabs 157 can be foldably connected to the third panel 131 at respective portions of a respective generally curved fold line 159, and can be positioned extending into the respective openings 167.

The openings 167, as shown, can each have a respective central portion 167*a*, a pair of longitudinally extending portions 167*b*, 167*c* extending in opposite directions from the central portion 167*a*, and a laterally extending portion 167*d* extending from the central portions 167*a*. The portions 167*b*, 167*c*, 167*d* can at least partially interrupt the fold line 159.

As also shown, the fourth panel 139 can include a pair of the laterally opposed container retention openings 151, each container retention opening 151 configured for at least partially receiving a respective container of the plurality of containers B when the carrier 105 is formed from the blank 103.

In this regard, the container retention openings 151, 155, 167, tabs 157, 163, and associated features can be container retention features of the blank 103 and the carrier 105 formed therefrom, though less than all the container retention openings 151, 155, 167, tabs 157, 163, and/or associated features can be the container retention features of the blank 103 and carrier 105 formed therefrom without departing from the disclosure. One or more of the container retention openings 151, 155, 167, tabs 157, 163, and/or associated features can have a different configuration and/or arrangement without departing from the disclosure.

The blank 103 and carrier 105 formed therefrom can also include handle features that form a handle 109 (FIG. 2) of the carrier 105.

In the illustrated embodiment, the handle features can include the handle portion 169 of the second panel 123 that is foldably connected to the respective end portions or container retention portions 171, 173 of the second panel 123 at the respective longitudinal fold lines 174, 175. The handle portion 169 of the second panel 123 can include a plurality of lines of weakening 177 therealong to facilitate use of the handle 109 when the carrier 105 is formed from the blank 103. In some embodiments, the lines of weakening 177 can be longitudinal fold lines or creases, though a different number and/or arrangement of lines of weakening can be provided without departing from the disclosure. In some embodiments, the handle portion 169 of the second panel 123 can be devoid of lines of weakening.

As also shown, a pair of handle reinforcement flaps 179, 181 can be foldably connected to the handle portion 169 of the second panel 123 at respective curved fold lines 183, 185 such that the handle reinforcement flaps 179, 181 are positioned extending into the respective openings 129, 137.

A pair of handle reinforcement flaps 187, 189 can also be foldably connected to the third panel 131 at respective curved fold lines 191, 193 such that the handle reinforcement flaps 191, 193 are positioned extending into the respective openings 137, 145.

Figure 2:
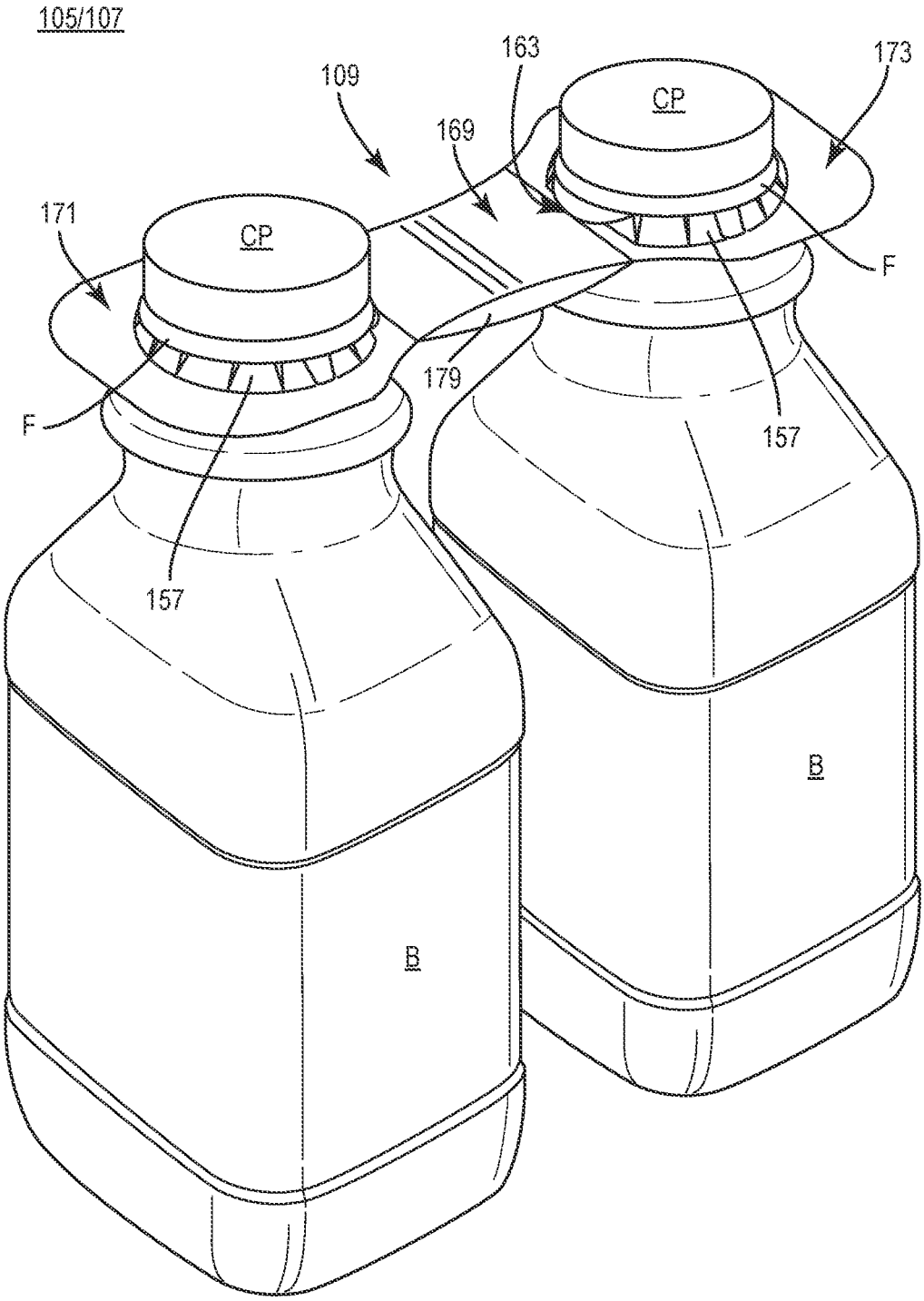
FIG. 2 is a perspective view of a carrier formed from the blank of FIG. 1 according to the first exemplary embodiment of the disclosure.

Turning to FIG. 2, according to one embodiment, the first panel 121 can be folded at the fold line 125 into at least partial face-to-face contact with the second panel 123. In particular, an interior surface of the first panel 121 (e.g., a surface opposite the exterior surface 101 of the blank 103) can be positioned in at least partial face-to-face contact with the interior surface of the second panel 123.

The fourth panel 139 can be folded at the fold line 141 such that the interior surface of the fourth panel 139 is positioned in at least partial face-to-face contact with the interior surface of the third panel 131.

Thereafter, the overlapped third panel 131 and fourth panel 139 can be together folded at the fold line 133 such that the exterior surface of the fourth panel 139 is positioned in at least partial face-to-face contact with the exterior surface of the first panel 121.

In such an arrangement, the second panel 123 is positioned with an exterior surface thereof facing upwardly and an interior surface thereof facing downwardly and in at least partial face-to-face contact with the interior surface of the first panel 121, the exterior surface of the first panel 121 is positioned facing downwardly and in at least partial face-to-face contact with the exterior surface of the fourth panel 139, the interior surface of the fourth panel 139 is positioned facing downwardly and in at least partial face-to-face contact with the interior surface of the third panel 131, and the exterior surface of the third panel 131 is positioned facing downwardly. In this regard, the first panel 121 and the fourth panel 139 are positioned between the second panel 123 and the third panel 131.

The aforementioned construction of the carrier 105 can be at least partially maintained with at least one or more applications of an adhesive such as glue. In some embodiments, an adhesive such as glue can be applied to respective portions of the exterior surface of the panel 131 along the central portion 131*c* and end portions 131*a*, 131*b* thereof. In some embodiments, an adhesive such as glue can be applied to respective portions of the panels 121, 139 to facilitate formation of the carrier 105.

Such an arrangement provides a reinforced, multi-ply (e.g., four-ply) arrangement of the panels of the carrier 105 that affords a robust construction and resistance to tearing or other damage as compared to, for example, a carrier construction that lacks such an arrangement of multiple plies.

In addition, the respective container retention openings 151, 155, 167 on respective lateral end positions of the panels 121, 123, 131, 139 can be arranged in general alignment for at least partially receiving containers B, as described further below.

Furthermore, the handle portion 169 of the second panel 123 can be aligned above the respective central portions 121*c*, 139*c*, 131*c* of the panels 121, 139, 131, and the handle reinforcement flaps 179, 189 and handle reinforcement flaps 181, 187 can be aligned over each other extending away therefrom to provide the handle 109. In this regard, in some embodiments, the central portions 121*c*, 139*c*, 131*c* of the panels 121, 139, 131 can be considered handle features of the blank 103 and carrier 105 formed therefrom.

Turning to FIG. 3, the carrier 105 can be positioned to at least partially receive/engage respective containers B to form a package 107. In some embodiments, at least the cap CP and/or flange portion F of a respective container B can be at least partially received through respective aligned container retention openings 151, 155, 167 to form the package 107.

Such movement of portions of a respective container B through respective aligned container retention openings 151, 155, 167 can cause respective container retention tabs 157 to fold upwardly at respective portions of the respective fold lines 159 such that the container retention tabs 157 extend from the respective panels 123, 131 to the underside of the respective flange portion F of a respective container B, e.g., in a bracing/tightening relationship.

Furthermore, the base portion 163*a* of the container retention tabs 163 can move or flex upwardly relative to the second panel 123, with the distal portion 163*b* thereof at least partially folding backwardly at the fold line 163*c* to extend to and past the underside of the flange portion F of the respective container B in a direction opposite the direction in which the container retention tabs 157 extend. Such an arrangement of the container retention tabs 163 can, for example, take up empty space between the containers B and portions of the carrier 105 and/or otherwise tighten the engagement of the carrier 105 with the containers B.

In some embodiments, the oblique 153*a*, 153*b* and/or curved 153*c* segments of the respective container retention openings 151 can at least partially engage, e.g., via compression and/or frictional/interfering engagement, a portion of a respective container B extending therethrough, e.g., a respective neck portion N thereof, in order to enhance engagement of the carrier 105 and the respective containers B.

In order to lift and/or carry the package 107/carrier 105, a user can grasp the handle 109, for example, by at least partially curling his or her hand/fingers around the handle portion 169 of the panel 123 and the aligned portions 121*c*, 139*c*, 131*c* of the panels 121, 139, 131 therebelow. Such engagement of the package 107/carrier 105 by the user can cause the aligned handle reinforcement flaps 179, 187 and/or aligned handle reinforcement flaps 181, 189 to fold downwardly at the respective aligned fold lines 183, 191 and/or aligned fold lines 185, 193 so as to be positioned between the user's hand and the remainder of the handle 109.

In this regard, in some embodiments, the handle reinforcement flaps 179, 187 and/or handle reinforcement flaps 181, 189 can provide an additional two plies of material between a user's hand and the aligned panels 123, 121, 139, 131, for example, for comfort and/or grip strength, to avoid tearing or other unwanted damage of the package 107/carrier 105, etc.

Furthermore, and with additional reference to FIG. 3, during the course of lifting and/or carrying the package 107/carrier 105 by a user, the lines of weakening 177 can facilitate relative movement and/or curving of the handle portion 169 of the second panel 123, and, in some embodiments, the portions 121*c*, 139*c*, 131*c* of the respective panels 121, 139, 131 therebelow, for example, to facilitate a comfortable grip and/or beneficial distribution of stresses across portions of the handle 109 during use.

In this regard, the handle 109 of the package 107/carrier 105 and associated features can be positioned between the container retention features of the package 107/carrier 105 such that a symmetrically and conveniently positioned handle 109 is provided between portions of the package 107/carrier 105 that support the containers B.

The aforementioned blank 103 and carrier 105 formed therefrom have a beneficial configuration and arrangement that provides a reinforced carrier structure with multiple plies of material to facilitate supporting a plurality of containers while avoiding tearing or other unwanted damage to the carrier.

Furthermore, the arrangement and configuration of the container retention features of the blank 103 and carrier 105 formed therefrom facilitates a secure engagement of the containers B to the carrier 105, and the handle features of the blank 103 and carrier 105 formed therefrom provide a comfortable, reinforced grip that is suitable for allowing a user to carry multiple containers B without discomfort or unwanted tearing or other damage to the carrier 105.

Figure 4:
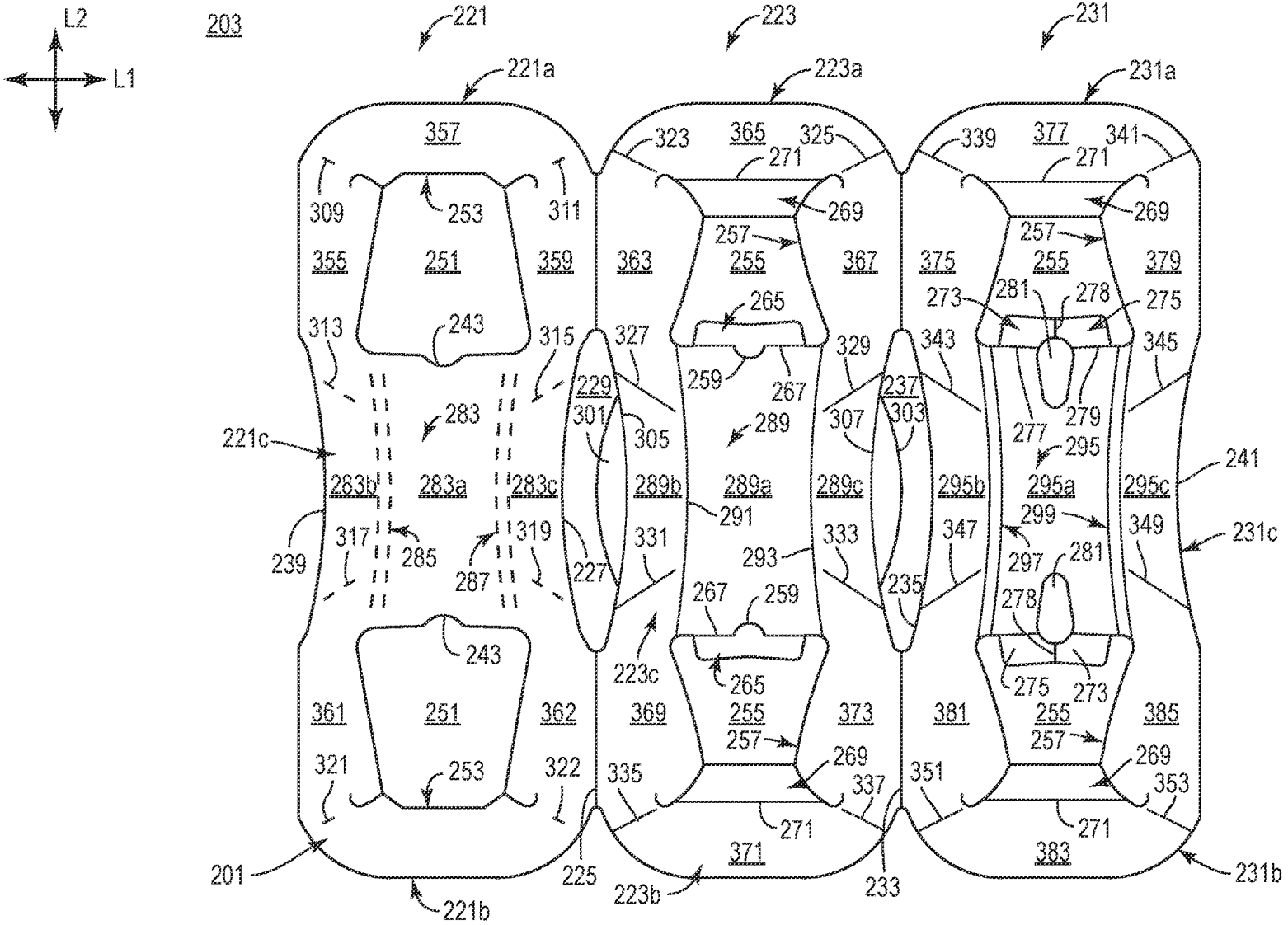
FIG. 4 is a plan view of an exterior surface of a blank for forming a carrier for containers according to a second exemplary embodiment of the disclosure.

Turning to FIG. 4, an exterior surface 201 of a blank 203 for forming a carrier 205 for supporting a plurality of containers B is illustrated according to a second exemplary embodiment of the disclosure. The blank 203 and carrier 205 formed therefrom can have one or more features that are the same or similar to those described above with respect to the blank 103 and carrier 105 formed therefrom, and like or similar features are designated with like or similar reference numerals.

While the carrier 205 formed from the blank 203 can be for at least partially receiving and supporting a pair of the containers B, it will be understood that the blank 203 and carrier 205 formed therefrom can be configured to receive and/or support a different number of containers B without departing from the disclosure. The carrier 205 formed from the blank 203 can be provided with one or more containers B as a package 207.

As shown, the blank 203 can have the longitudinal axis L1, the lateral axis L2, and a plurality of panels. The plurality of panels can include a first top panel or first attachment panel or first panel 221 foldably connected to a second top panel or second attachment panel or second panel 223 at a lateral fold line 225 interrupted by a generally ovoid cut 227 that defines a generally ovoid first opening 229. A third top panel or third attachment panel or third panel 231 can be foldably connected to the second panel 223 at a lateral fold line 233 that is interrupted by a generally ovoid cut 235 that defines a generally ovoid second opening 237.

Generally curved cuts 239, 241 can also be at least partially defined along free edge portions of the panels 221, 231 such that the arrangement of cuts 227, 235, 239, 241 forms the plurality of panels 221, 223, 231 having respective generally tapering/narrower central portions in the lateral direction, and respective lateral end portions wider than the respective central portions.

In this regard, the panel 221 can include a pair of laterally opposed end portions 221*a*, 221*b* (broadly, "first end portion" and "second end portion", respectively), and a relatively tapered/narrower central portion 221*c* extending from the portion 221*a* to the portion 221*b*. Similarly, the panel 223 can include a pair of laterally opposed end portions 223*a*, 223*b* (broadly, "first end portion" and "second end portion", respectively), and a relatively tapered/narrower central portion 223*c* extending from the portion 223*a* to the portion 223*b*. The panel 231 can include a pair of laterally opposed end portions 231*a*, 231*b* (broadly, "first end portion" and "second end portion", respectively), and a relatively tapered/narrower central portion 231*c* extending from the portion 231*a* to the portion 231*b*.

It will be understood that one or more of the panels of the blank 203 and carrier 205 formed therefrom can have a different configuration and/or arrangement without departing from the disclosure.

The blank 203 and carrier 205 formed therefrom can include a plurality of container retention features for at least partially receiving one or more containers of the plurality of containers B. In the illustrated embodiment, a pair of container retention openings 251 (broadly respective "first container retention opening" and "second container retention opening") can be at least partially defined in laterally opposed portions of the first panel 221 and for at least partially receiving a respective container of the plurality of containers B when the carrier 205 is formed from the blank 203, as described further herein.

Figure 4A:
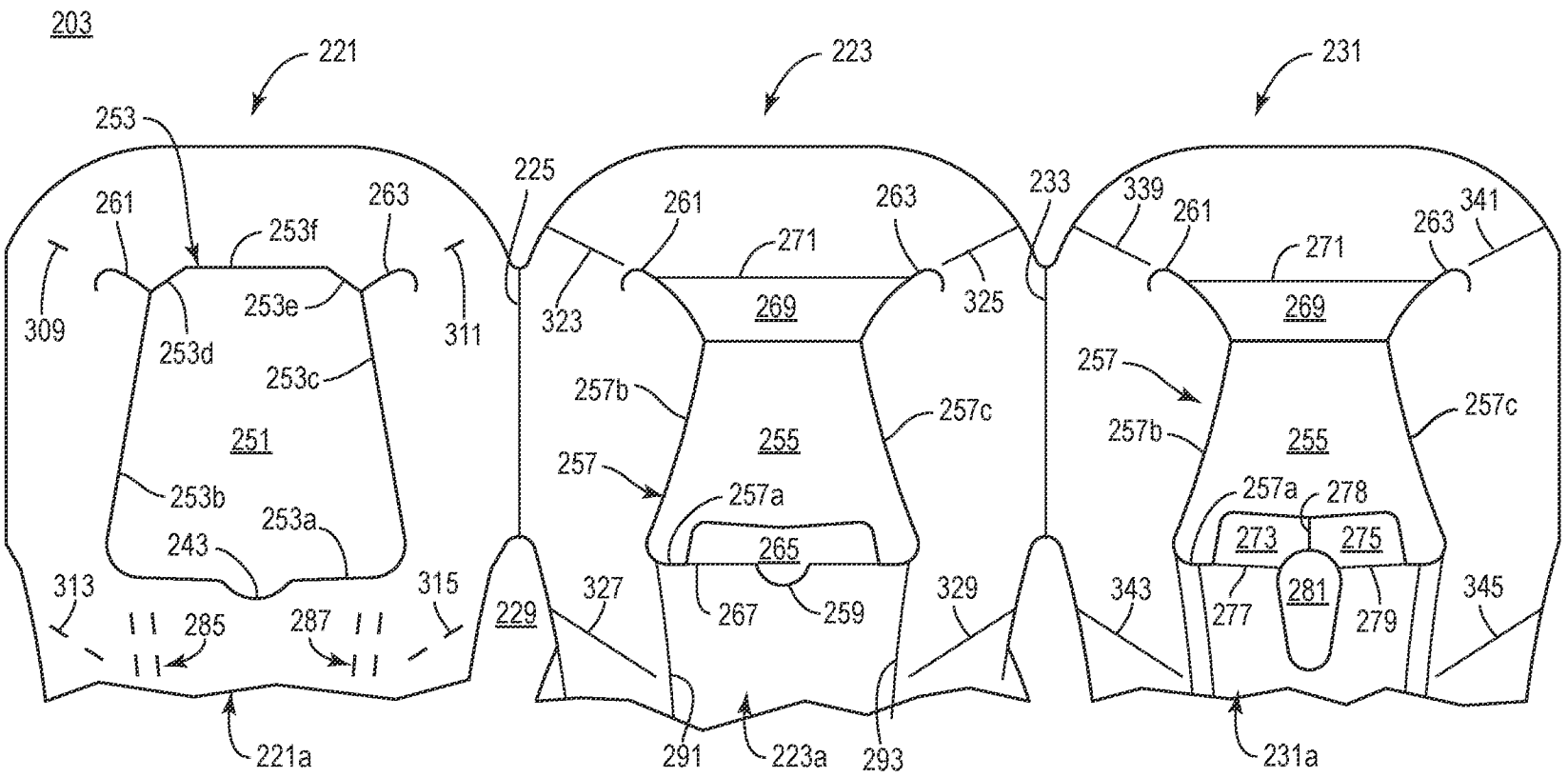
FIG. 4A is an enlarged view of a portion of the blank of FIG. 4.

With additional reference to FIG. 4A, each container retention opening 251, as shown, can be at least partially defined by a respective cut 253 having a generally longitudinal or generally curved lower segment 253*a*, a pair of generally oblique segments 253*b*, 253*c* extending upwardly and inwardly from respective endpoints of the segment 253*a*, a pair of further generally oblique segments 253*d*, 253*e* extending upwardly and inwardly from respective endpoints of the respective segments 253*b*, 253*c*, and a generally longitudinal upper segment 253*f* extending from an endpoint of the segment 253*d* to an endpoint of the segment 253*e*.

A generally semicircular relief cut 243, as shown, can interrupt the lower segment 253*a* of the cut 253, and a pair of generally J-shaped relief cuts 261, 263 can extend away from respective endpoints of the oblique segments 253*b*, 253*c* of the cut 253.

A pair of laterally opposed container retention openings 255 (broadly respective "first container retention opening" and "second container retention opening") can also be defined in the second panel 223, each configured for receiving a portion of a respective container of the plurality of containers B when the carrier 205 is formed from the blank 203, as described further herein. Each opening 255 can be at least partially defined by a cut 257 that includes a generally longitudinal lower segment 257*a*, and a pair of generally oblique segments 257*b*, 257*c* extending upwardly and inwardly from respective endpoints of the segment 257*a*. A generally semicircular relief cut 259, as shown, can at least partially interrupt the lower segment 257*a* of the cut 257.

A container retention tab 265, as shown, can be at least partially foldably connected to the second panel 223 at respective generally longitudinal fold lines 267 that are coextensive with respective segments 257*a* of the respective cut 257, and positioned to extend at least partially into the respective container retention opening 255. In this regard, the longitudinal fold lines 267 can be at least partially interrupted by the respective cuts 259.

A container retention tab 269 can also be positioned extending into the respective container retention openings 255 of the second panel 223 and can be foldably connected to respective portions of the second panel 223 at a respective generally longitudinal fold line 271, the endpoints of which a pair of the relief cuts 261, 263 extend, as shown.

A pair of the laterally opposed container retention openings 255 can also be defined in the third panel 231, each at least partially defined by a respective cut 257. As also shown, a pair of the relief cuts 261, 263 can be positioned extending away from the longitudinal fold lines 271 in the third panel 231.

In the illustrated embodiment, a pair of container retention tabs 273, 275 can be positioned extending at least partially the container retention opening 255 in the respective end portions 231*a*, 231*b* of the third panel 231, the container retention tabs 273, 275 at least partially foldably connected to the third panel 231 at respective generally longitudinal fold lines 277, 279 and at least partially separated at a respective generally lateral cut 278.

As shown, the cut 278 can at least partially intersect a generally tapered ovoid opening 281 that extends at least partially into the central portion 231*c* of the third panel 231, and the fold line 267 can be interrupted by another opening 281 extending at least partially into the central portion 231*c* of the third panel 231.

Container retention tabs 269 can also be positioned extending into the respective container retention openings 255 and foldably connected to respective portions of the third panel 231 at a respective generally longitudinal fold line 271.

In this regard, the container retention openings 251, 255, tabs 265, 269, 273, 275, and associated features can be container retention features of the blank 203 and the carrier 205 formed therefrom, though less than all the container retention openings 251, 255, tabs 265, 269, 273, 275, and associated features can be the container retention features of the blank 203 and carrier 205 formed therefrom without departing from the disclosure. One or more of the container retention openings 251, 255, tabs 265, 269, 273, 275, and associated features can have a different configuration and/or arrangement without departing from the disclosure.

The blank 203 and carrier 205 formed therefrom can also include handle features that form a handle 209 of the carrier 205.

In the illustrated embodiment, the handle features can include a handle portion 283 in the first panel 221 defined proximate respective pluralities of curved lines of weakening 285, 287 in the central portion 221*c* of the first panel 221. As shown, the handle portion 283 can include a central handle portion 283*a* between the respective pluralities of curved lines of weakening 285, 287, a first outer handle portion 283*b* extending from the plurality of curved lines of weakening 285 to a free edge of the first panel 221, and a second outer handle portion 283*c* extending from the plurality of curved lines of weakening 287 to an opposite free edge of the first panel 221.

A handle portion 289 can be at least partially defined proximate respective curved lines of weakening 291, 293 in the central portion 223*c* of second panel 223 and that intersect respective segments 257*a* of the cuts 257 in the second panel 223. As shown, the handle portion 289 can include a central handle portion 289*a* between the respective pluralities of curved lines of weakening 291, 293, a first outer handle portion 289*b* extending from the plurality of curved lines of weakening 291 to one or more free edges of the second panel 223, and a second outer handle portion 289*c* extending from the plurality of curved lines of weakening 293 to one or more opposite free edges of the second panel 223.

A handle portion 295 can be at least partially defined proximate respective pluralities of curved lines of weakening 297, 299 in the central portion 231*c* of the third panel 231 and that intersect respective segments 257*a* of the cuts 257 in the third panel 231. As shown, the handle portion 295 can include a central handle portion 295*a* between the respective pluralities of curved lines of weakening 297, 299, a first outer handle portion 295*b* extending from the plurality of curved lines of weakening 297 to a free edge of the third panel 231, and a second outer handle portion 295*c* extending from the plurality of curved lines of weakening 299 to an opposite free edge of the third panel 223.

As also shown, a pair of handle reinforcement flaps 301, 303 can be foldably connected to the central portion 223*c* of the second panel 223 at respective curved fold lines 305, 307 such that the handle reinforcement flaps 301, 303 are positioned extending into the respective openings 229, 237.

The blank 203 and the carrier 205 formed therefrom can also include reconfigurable features for at least partially reconfiguring one or more of the panels 221, 223, 231 upon engagement of the carrier 205 with one or more containers B.

In the illustrated embodiment, the reconfigurable features can include oblique lines of weakening or oblique fold lines 309, 311 positioned in the end portion 221*a* of the first panel 221, oblique lines of weakening or oblique fold lines 313, 315, 317, 319 positioned in the central portion 221*c* of the first panel 221, and oblique fold lines 321, 322 positioned in the end portion 221*b* of the first panel 221.

In some embodiments, a lateral reconfigurable portion 355 can be at least partially defined between the fold lines 309, 313, a longitudinal reconfigurable portion 357 can be at least partially defined between the fold lines 309, 311, a lateral reconfigurable portion 359 can be at least partially defined between the fold lines 311, 315, a lateral reconfigurable portion 361 can be at least partially defined between the fold lines 317, 321, and a lateral reconfigurable portion 362 can be at least partially defined between the fold lines 319, 322. As also shown, the outer handle portion 283*b* can be at least partially defined between the fold lines 313, 317 and the outer handle portion 283*c* can be at least partially defined between the fold lines 315, 319.

Similarly, oblique lines of weakening or oblique fold lines 323, 325 can be positioned in the end portion 223*a* of the second panel 223, oblique fold lines 327, 329, 331, 333 can be positioned in the central portion 223*c* of the second panel 223, and oblique fold lines 335, 337 can be positioned in the end portion 223*b* of the second panel 223.

In some embodiments, a lateral reconfigurable portion 363 can be at least partially defined between the fold lines 323, 327, a longitudinal reconfigurable portion 365 can be at least partially defined between the fold lines 323, 325, a lateral reconfigurable portion 367 can be at least partially defined between the fold lines 325, 329, a lateral reconfigurable portion 369 can be at least partially defined between the fold lines 331, 335, a longitudinal reconfigurable portion 371 can be at least partially defined between the fold lines 335, 337, and a lateral reconfigurable portion 373 can be at least partially defined between the fold lines 333, 337. As also shown, the outer handle portion 289*b* can be at least partially defined between the fold lines 327, 331 and the outer handle portion 289*c* can be at least partially defined between the fold lines 329, 333.

Similarly still, oblique lines of weakening or oblique fold lines 339, 341 can be positioned in the end portion 231*a* of the third panel 231, oblique fold lines 343, 345, 347, 349 can be positioned in the central portion 231*c* of the third panel 231, and oblique fold lines 351, 353 can be positioned in the end portion 231*b* of the third panel 231.

In some embodiments, a lateral reconfigurable portion 375 can be at least partially defined between the fold lines 339, 343, a longitudinal reconfigurable portion 377 can be at least partially defined between the fold lines 339, 341, a lateral reconfigurable portion 379 can be at least partially defined between the fold lines 341, 345, a lateral reconfigurable portion 381 can be at least partially defined between the fold lines 347, 351, a longitudinal reconfigurable portion 383 can be at least partially defined between the fold lines 351, 353, and a lateral reconfigurable portion 385 can be at least partially defined between the fold lines 349, 353. As also shown, the outer handle portion 295*b* can be at least partially defined between the fold lines 343, 347 and the outer handle portion 295*c* can be at least partially defined between the fold lines 345, 349.

Figure 5:
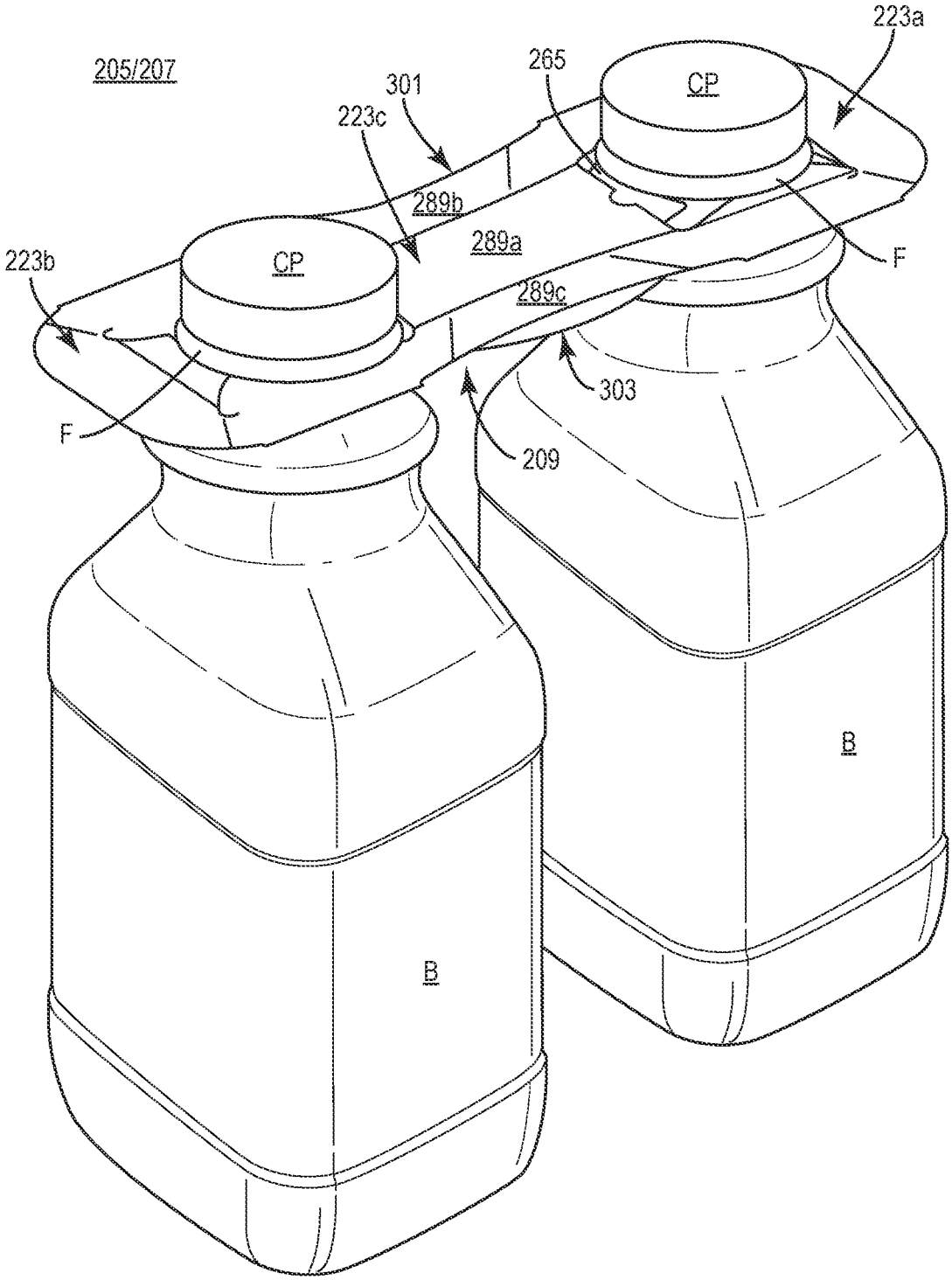
FIG. 5 is a perspective view of a carrier formed from the blank of FIG. 4 according to the second exemplary embodiment of the disclosure.

Turning to FIG. 5, according to one embodiment, the first panel 221 can be folded at the fold line 225 into at least partial face-to-face contact with the second panel 223. In particular, an interior surface of the first panel 221 (e.g., a surface opposite the exterior surface 201 of the blank 203) can be positioned in at least partial face-to-face contact with the interior surface of the second panel 223.

Thereafter, the third panel 231 can be folded at the fold line 233 such that interior surface of the third panel 231 is positioned in at least partial face-to-face contact with the exterior surface of the second panel 223.

In such an arrangement, the second panel 223 is positioned with an exterior surface thereof facing upwardly and an interior surface thereof facing downwardly and in at least partial face-to-face contact with the interior surface of the first panel 221, the exterior surface of the first panel 221 is positioned facing downwardly and in at least partial face-to-face contact with the interior surface of the third panel 231, and the exterior surface of the third panel 231 is positioned facing downwardly. In this regard, the first panel 221 is positioned between the second panel 223 and the third panel 231.

The aforementioned construction of the carrier 205 can be at least partially maintained with at least one or more applications of an adhesive such as glue. In some embodiments, an adhesive such as glue can be applied to respective portions of the interior surface of the panel 221 and to respective portions of the interior surface of the panel 231.

Such an arrangement provides a reinforced, multi-ply (e.g., three-ply) arrangement of the panels of the carrier 205 that affords a robust construction and resistance to tearing or other damage as compared to, for example, a carrier construction that lacks such an arrangement of multiple plies.

In addition, the respective container retention openings 251, 255 on respective lateral end portions of the panels 221, 223, 231 can be arranged in general alignment for at least partially receiving containers B, as described further below.

Furthermore, the handle portion 289 of the second panel 223 can be aligned above the handle portions 283, 295 of the panels 221, 231 therebelow, as well as the handle reinforcement flaps 301, 303 extending away therefrom, to provide the handle 209.

The carrier 205 can be positioned to at least partially receive/engage respective containers B to form a package 207. In some embodiments, at least the cap CP and/or flange portion F of a respective container B can be at least partially received through respective aligned container retention openings 251, 255 to form the package 207.

Such movement of portions of a respective container B through respective aligned container retention openings 251, 255 can cause respective container retention tabs 265, 269, 273, 275 to fold upwardly at respective portions of the respective fold lines 267, 271, 277, 279 such that the container retention tabs 265, 269, 273, 275 extend from the respective panels 223, 231 to the underside of the respective flange portion F of a respective container B, e.g., in a bracing/tightening relationship.

In some embodiments, the one or more portions of the respective container retention openings 251, 255, e.g., respective oblique portions of the respective cuts thereof, can at least partially engage, e.g., via compression and/or frictional/interfering engagement, a portion of a respective container B extending therethrough, e.g., a respective neck portion N thereof, in order to enhance engagement of the carrier 205 and the respective containers B.

Figure 6:
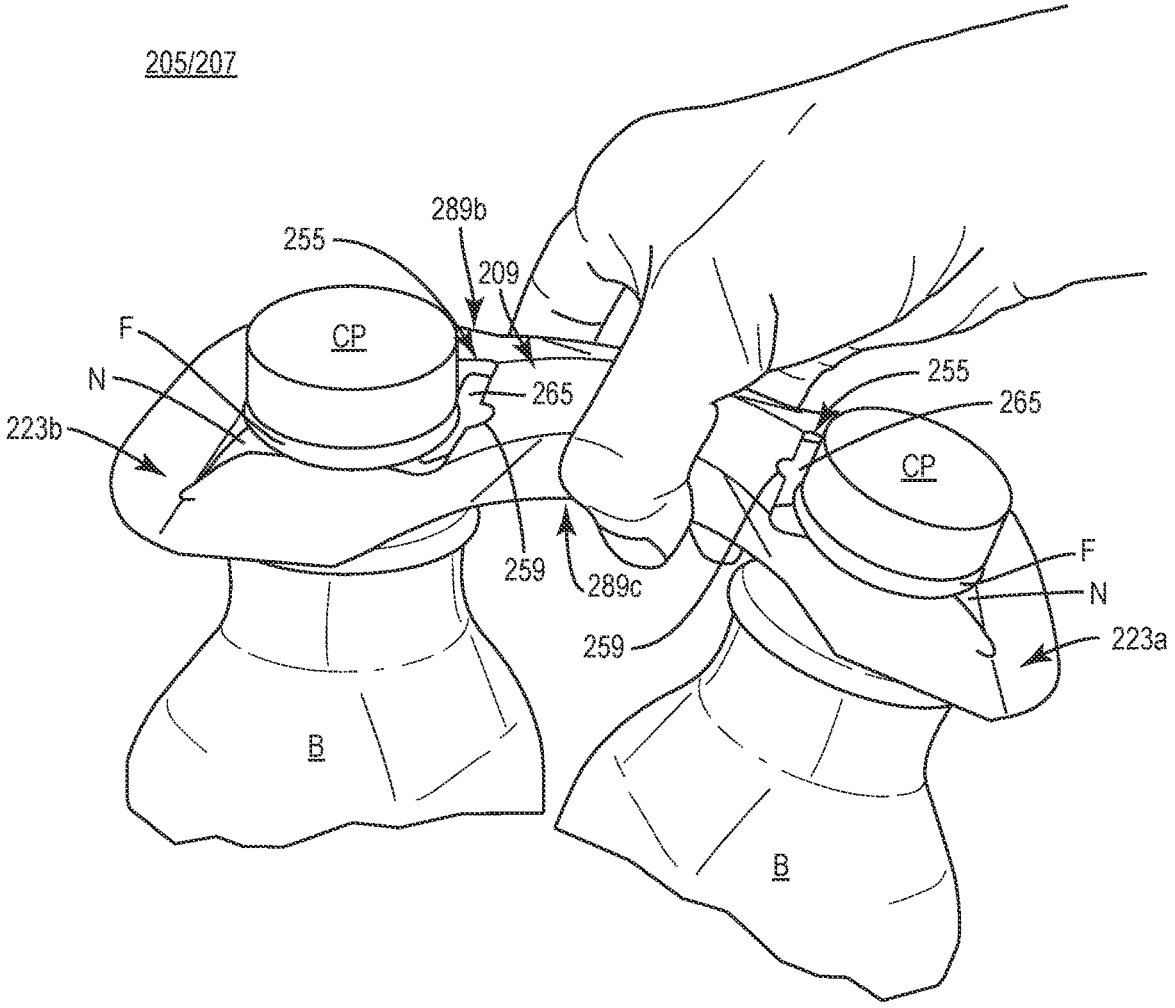
FIG. 6 is a perspective view of a portion of the carrier of FIG. 5 being lifted by a user.

With additional reference to FIG. 6, in order to lift and/or carry the package 207/carrier 205, a user can grasp the handle 209, for example, by at least partially curling his or her hand/fingers around the handle portions 283, 289, 295 of the respective panels 221, 223, 231. Such engagement of the package 207/carrier 205 by the user can cause the handle reinforcement flaps 301, 303 to fold at least partially downwardly at the respective fold lines 305, 307 so as to be positioned between the user's hand and the remainder of the handle 209.

In this regard, in some embodiments, the handle reinforcement flaps 301, 303 can provide an additional ply of material between a user's hand and the aligned panels 223, 221, 231, for example, for comfort and/or grip strength, to avoid tearing or other unwanted damage of the package 207/carrier 205, etc.

Furthermore, the respective reconfigurable features can cause, via relative movement of one or more portions of the respective panels 221, 223, 231 at one or more of the respective reconfigurable portions 355, 357, 359, 361, 362, 363, 365, 367, 369, 371, 373, 375, 377, 379, 381, 383, 385 at the respective oblique lines of weakening 309, 311, 313, 315, 317, 319, 321, 322, 323, 325, 327, 329, 331, 333, 335, 337, 339, 341, 343, 345, 347, 349, 351, 353, can cause at least partial reconfiguration of the carrier 205/package 207, e.g., to relieve stresses transmitted along the carrier package 205/package 207 due to lifting and/or carrying the carrier 205/package 207 and/or due to engagement with the containers B.

In the illustrated embodiment, the lines of weakening 309, 311, 313, 315, 317, 319, 321, 322, 323, 325, 327, 329, 331, 333, 335, 337, 339, 341, 343, 345, 347, 349, 351, 353 can facilitate the aligned end portions 221*a*, 223*a*, 231*a* and aligned end portions 221*b*, 223*a*, 231*c* of the respective panels 221, 223, 231 to raise at least partially upwardly and/or downwardly relative to the respective aligned central portions 221*c*, 223*c*, 231*c* of the respective panels 221, 223, 231.

Furthermore, during the course of lifting and/or carrying the package 207/carrier 205 by a user, the lines of weakening 309, 311, 313, 315, 317, 319, 321, 322, 323, 325, 327, 329, 331, 333, 335, 337, 339, 341, 343, 345, 347, 349, 351, 353, 285, 287, 291, 293, 297, 299 can facilitate relative movement and/or curving of the handle 209, for example, to facilitate a comfortable grip and/or beneficial distribution of stresses across portions of the handle 209 during use. In some embodiments, one or more of the relief cuts 261, 263 can facilitate planar flexion of the respective panels 221, 223, 231, for example, relative to a plane defined by the axes L1, L2, to provide relief to stresses associated with the engagement of the containers B at least partially received through the respective container retention openings 251, 255.

In this regard, the handle 209 of the package 207/carrier 205 and associated features can be positioned between the container retention features of the package 207/carrier 205 such that a symmetrically and conveniently positioned handle 209 is provided between portions of the package 207/carrier 205 that support the containers B, with advantages similar to those described above with respect to the carrier 105 and package 107.

Figure 7:
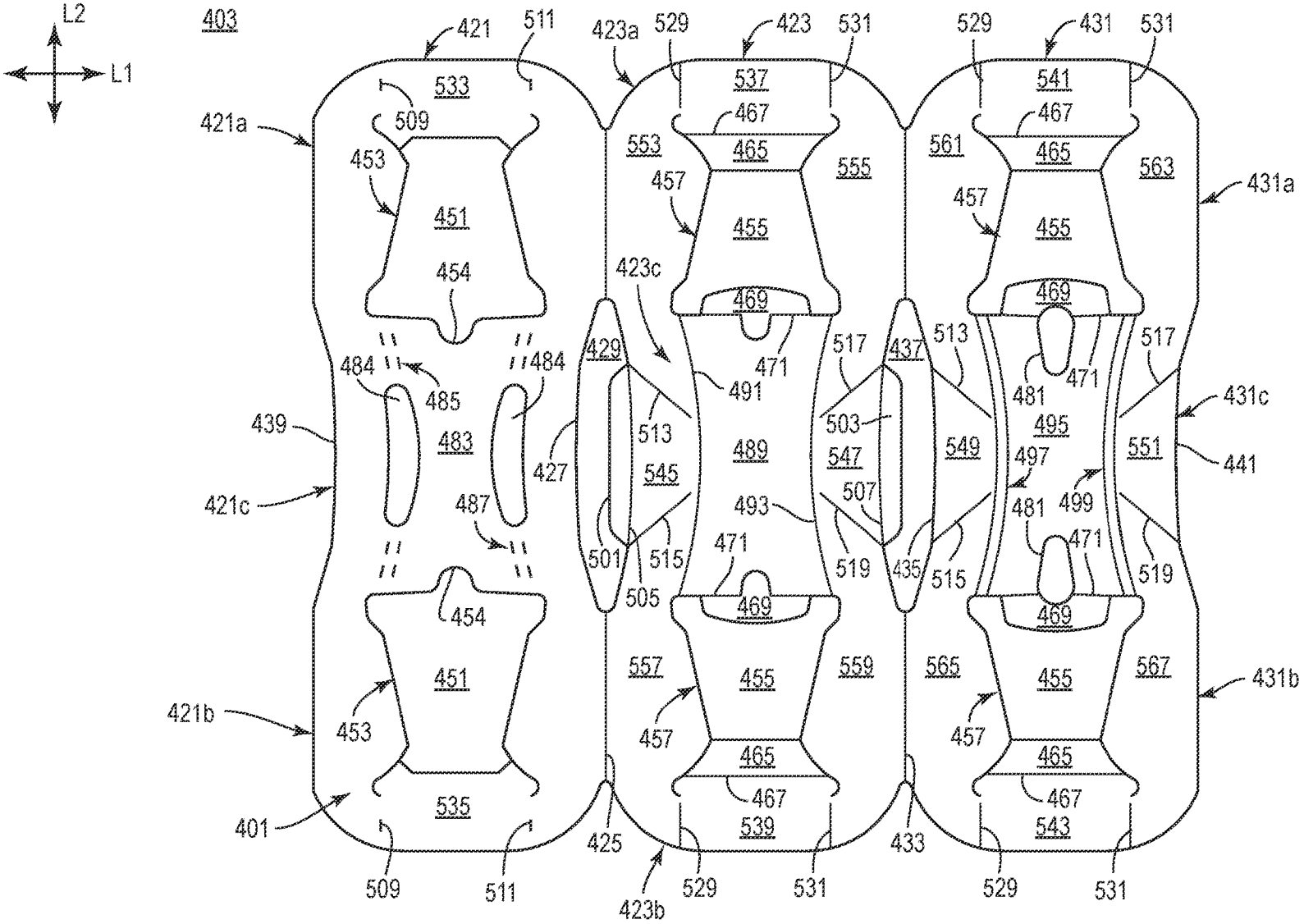
FIG. 7 is a plan view of an exterior surface of a blank for forming a carrier for containers according to a third exemplary embodiment of the disclosure.
Figure 7A:
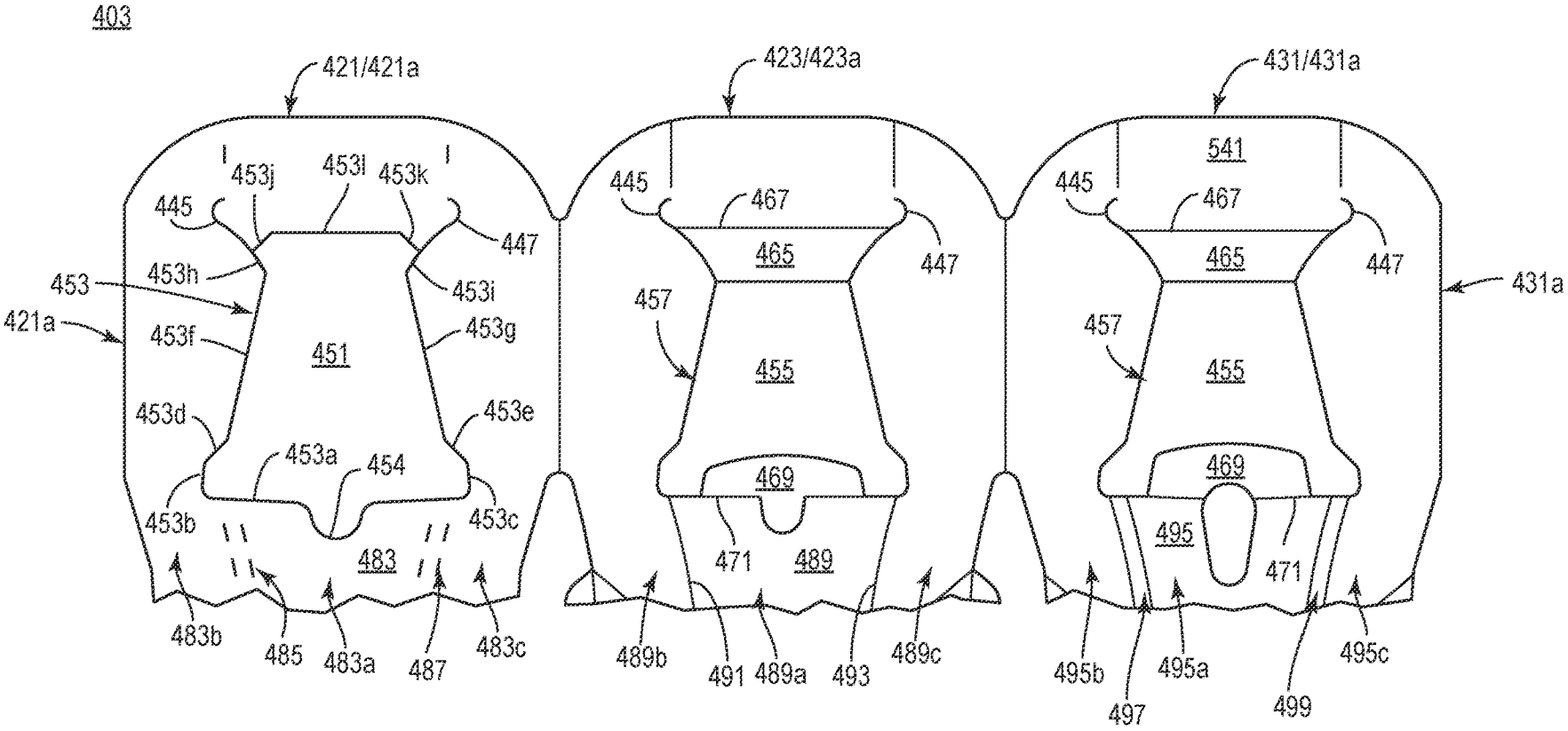
FIG. 7A is an enlarged view of a portion of the blank of FIG. 7.

Turning to FIGS. 7 and 7A, an exterior surface 401 of a blank 403 for forming a carrier 405 for supporting a plurality of containers B is illustrated according to a third exemplary embodiment of the disclosure. The blank 403 and carrier 405 formed therefrom can have one or more features that are the same or similar to those described above with respect to the blanks 103, 203 and carriers 105, 205 formed therefrom, and like or similar features are designated with like or similar reference numerals.

While the carrier 405 formed from the blank 403 can be for at least partially receiving and supporting a pair of the containers B, it will be understood that the blank 403 and carrier 405 formed therefrom can be configured to receive and/or support a different number of containers B without departing from the disclosure. The carrier 405 formed from the blank 403 can be provided with one or more containers B as a package 407.

As shown, the blank 403 can have the longitudinal axis L1, the lateral axis L2, and a plurality of panels. The plurality of panels can include a first top panel or first attachment panel or first panel 421 foldably connected to a second top panel or second attachment panel or second panel 423 at a lateral fold line 425 interrupted by a generally ovoid cut 427 that defines a generally ovoid first opening 429. A third top panel or third attachment panel or third panel 431 can be foldably connected to the second panel 423 at a lateral fold line 433 that is interrupted by a generally ovoid cut 435 that defines a generally ovoid second opening 437.

Generally curved cuts 439, 441 can also be at least partially defined along free edge portions of the panels 421, 431 such that the arrangement of cuts 427, 435, 439, 441 forms the plurality of panels 421, 423, 431 having respective generally tapering/narrower central portions in the lateral direction, and respective lateral end portions wider than the respective central portions.

In this regard, the panel 421 can include a pair of laterally opposed end portions 421*a*, 421*b* (broadly, "first end portion" and "second end portion", respectively), and a relatively tapered/narrower central portion 421*c* extending from the portion 421*a* to the portion 421*b*. Similarly, the panel 423 can include a pair of laterally opposed end portions 423*a*, 423*b* (broadly, "first end portion" and "second end portion", respectively), and a relatively tapered/narrower central portion 423*c* extending from the portion 423*a* to the portion 423*b*. The panel 431 can include a pair of laterally opposed end portions 431*a*, 431*b* (broadly, "first end portion" and "second end portion", respectively), and a relatively tapered/narrower central portion 431*c* extending from the portion 431*a* to the portion 431*b*.

It will be understood that one or more of the panels of the blank 403 and carrier 405 formed therefrom can have a different configuration and/or arrangement without departing from the disclosure.

The blank 403 and carrier 405 formed therefrom can include a plurality of container retention features for at least partially receiving one or more containers of the plurality of containers B. In the illustrated embodiment, a pair of container retention openings 451 (broadly respective "first container retention opening" and "second container retention opening") can be at least partially defined in laterally opposed portions of the first panel 421 and for at least partially receiving a respective container of the plurality of containers B when the carrier 405 is formed from the blank 403, as described further herein.

Each container retention opening 451, as shown, can be at least partially defined by a respective cut 453 having a generally longitudinal or generally curved lower segment 453*a*, a pair of generally lateral segments 453*b*, 453*c* extending upwardly from endpoints of the segment 453*a*, a pair of generally oblique segments 453*d*, 453*e* extending upwardly and inwardly from respective endpoints of the segments 453*d*, 453*e*, a pair of further generally oblique segments 453*f*, 453*g* extending upwardly and inwardly from respective endpoints of the respective segments 453*d*, 453*e*, a pair of generally oblique segments 453*h*, 453*i* extending upwardly and outwardly from respective endpoints of the respective segments 453*f*, 453*g*, a pair of generally oblique segments 453*j*, 453*k* extending upwardly and inwardly from respective endpoints of the respective segments 453*j*, 453*k*, and a generally longitudinal upper segment 4531 extending from an endpoint of the segment 453*j* to an endpoint of the segment 453*k*.

A generally semicircular relief cut 454, as shown, can interrupt the lower segment 453*a* of the cut 453, and a pair of generally J-shaped relief cuts 445, 447 can extend away from respective endpoints of the oblique segments 453*h*, 353*i* of the cut 453.

A pair of laterally opposed container retention openings 455 (broadly respective "first container retention opening" and "second container retention opening") can also be defined in each of the second panel 423 and the third panel 431, each configured for receiving a portion of a respective container of the plurality of containers B when the carrier 405 is formed from the blank 403, as described further herein. Each opening 455 can be at least partially defined by a cut 457 that can be generally similar to the cuts 453 described above, though devoid of the segments 453*h*, 453*i*, 453*j*, 453*k*, 4531.

A pair of container retention tabs 465, as shown, can be at least partially foldably connected to the second panel 423 and the third panel 431 at respective generally longitudinal fold lines 467 and positioned to extend at least partially into the respective container retention opening 455.

A container retention tab 469 can also be positioned extending into opposite ends the respective container retention openings 455 and foldably connected to respective portions of the second panel 423 and the third panel 431 at a respective generally longitudinal fold line 471. As shown, a respective generally tapered ovoid opening 481 can interrupt the respective fold lines 471 in the third panel 431.

In this regard, the container retention openings 451, 455, tabs 465, 469, and associated features can be container retention features of the blank 403 and the carrier 405 formed therefrom, though less than all the container retention openings 451, 455, tabs 465, 469, and associated features can be the container retention features of the blank 403 and carrier 405 formed therefrom without departing from the disclosure. One or more of the container retention openings 451, 455, tabs 465, 469, and associated features can have a different configuration and/or arrangement without departing from the disclosure.

The blank 403 and carrier 405 formed therefrom can also include handle features that form a handle 409 of the carrier 405.

In the illustrated embodiment, the handle features can include a handle portion 483 in the first panel 421 defined proximate respective pluralities of curved lines of weakening 485, 487 in the central portion 421*c* of the first panel 421. Respective openings 484 can interrupt the respective pluralities of lines of weakening 485, 487.

As shown, the handle portion 483 can include a central handle portion 483*a* between the respective pluralities of curved lines of weakening 485, 487, a first outer handle portion 483*b* extending from the plurality of curved lines of weakening 485 to a free edge of the first panel 421, and a second outer handle portion 483*c* extending from the plurality of curved lines of weakening 487 to an opposite free edge of the first panel 421.

A handle portion 489 can be at least partially defined proximate respective curved lines of weakening 491, 493 in the central portion 423*a* of second panel 423 and that intersect respective segments of the cuts 457 in the second panel 423. As shown, the handle portion 489 can include a central handle portion 489*a* between the curved lines of weakening 491, 493, a first outer handle portion 489*b* extending from the curved line of weakening 491 to one or more free edges of the second panel 423, and a second outer handle portion 489*c* extending from the curved line of weakening 493 to one or more opposite free edges of the second panel 423.

A handle portion 495 can be at least partially defined proximate respective pluralities of curved lines of weakening 497, 499 in the central portion 431*c* of the third panel 431 and that intersect respective segments of the cuts 457 in the third panel 431. As shown, the handle portion 495 can include a central handle portion 495*a* between the respective pluralities of curved lines of weakening 497, 499, a first outer handle portion 495*b* extending from the plurality of curved lines of weakening 497 to a free edge of the third panel 423, and a second outer handle portion 495*c* extending from the plurality of curved lines of weakening 499 to an opposite free edge of the third panel 423.

As also shown, a pair of handle reinforcement flaps 501, 503 can be foldably connected to the central portion 423*c* of the second panel 423 at respective curved fold lines 505, 507 such that the handle reinforcement flaps 501, 503 are positioned extending into the respective openings 429, 437.

The blank 403 and the carrier 405 formed therefrom can also include reconfigurable features for at least partially reconfiguring one or more of the panels 421, 423, 431 upon engagement of the carrier 405 with one or more containers B.

In the illustrated embodiment, the reconfigurable features can include lateral lines of weakening or lateral fold lines 509, 511 positioned in the each of the end portions 421*a*, 421*b* of the first panel 421, oblique lines of weakening or oblique fold lines 513, 515, 517, 519 positioned in each of the central portion 423*c* of the second panel 423 and the central portion 431*c* of the third panel 431, and lateral lines of weakening or lateral fold lines 529, 531 positioned in each of the end portions 423*a*, 423*b* of the second panel 423 and the end portions 431*a*, 431*b* of the third panel 431.

In some embodiments, a reconfigurable portion 533 can be at least partially defined between the fold lines 509, 511 in the end portion 421*a* of the panel 421, a reconfigurable portion 535 can be at least partially defined between the fold lines 509, 511 in the end portion 421*b* of the panel 421, a reconfigurable portion 537 can be at least partially defined between the fold lines 529, 531 in the end portion 423*a* of the panel 423, a reconfigurable portion 539 can be at least partially defined between the fold lines 529, 531 in the end portion 423*b* of the panel 423, a reconfigurable portion 541 can be at least partially defined between the fold lines 529, 531 in the end portion 431*a* of the panel 431, and a reconfigurable portion 543 can be at least partially defined between the fold lines 529, 531 in the end portion 431*b* of the panel 431.

Furthermore, a reconfigurable portion 545 can be at least partially defined between the fold lines 513, 515 in the central portion 423*c* of the panel 423, a reconfigurable portion 547 can be at least partially defined between the fold lines 517, 519 in the central portion 423*c* of the panel 423, a reconfigurable portion 549 can be at least partially defined between the fold lines 513, 515 in the central portion 431*c* of the panel 431, and a reconfigurable portion 551 can be at least partially defined between the fold lines 517, 519 in the central portion 431*c* of the panel 431.

Further still, a reconfigurable portion 553 can be at least partially defined between the fold lines 529, 513 in the end portion 423*a* of the panel 423, a reconfigurable portion 555 can be at least partially defined between the fold lines 531, 517 in the end portion 423*a* of the panel 423, a reconfigurable portion 557 can be at least partially defined between the fold lines 529, 515 in the end portion 423*b* of the panel 423, a reconfigurable portion 559 can be at least partially defined between the fold lines 531, 519 in the end portion 423*b* of the panel 423, a reconfigurable portion 561 can be at least partially defined between the fold lines 529, 513 in the end portion 431*a* of the panel 431, a reconfigurable portion 563 can be at least partially defined between the fold lines 531, 517 in the end portion 431*a* of the panel 431, a reconfigurable portion 565 can be at least partially defined between the fold lines 529, 515 in the end portion 431*b* of the panel 431, and a reconfigurable portion 567 can be at least partially defined between the fold lines 531, 519 in the end portion 431*b* of the panel 431.

Figure 8:
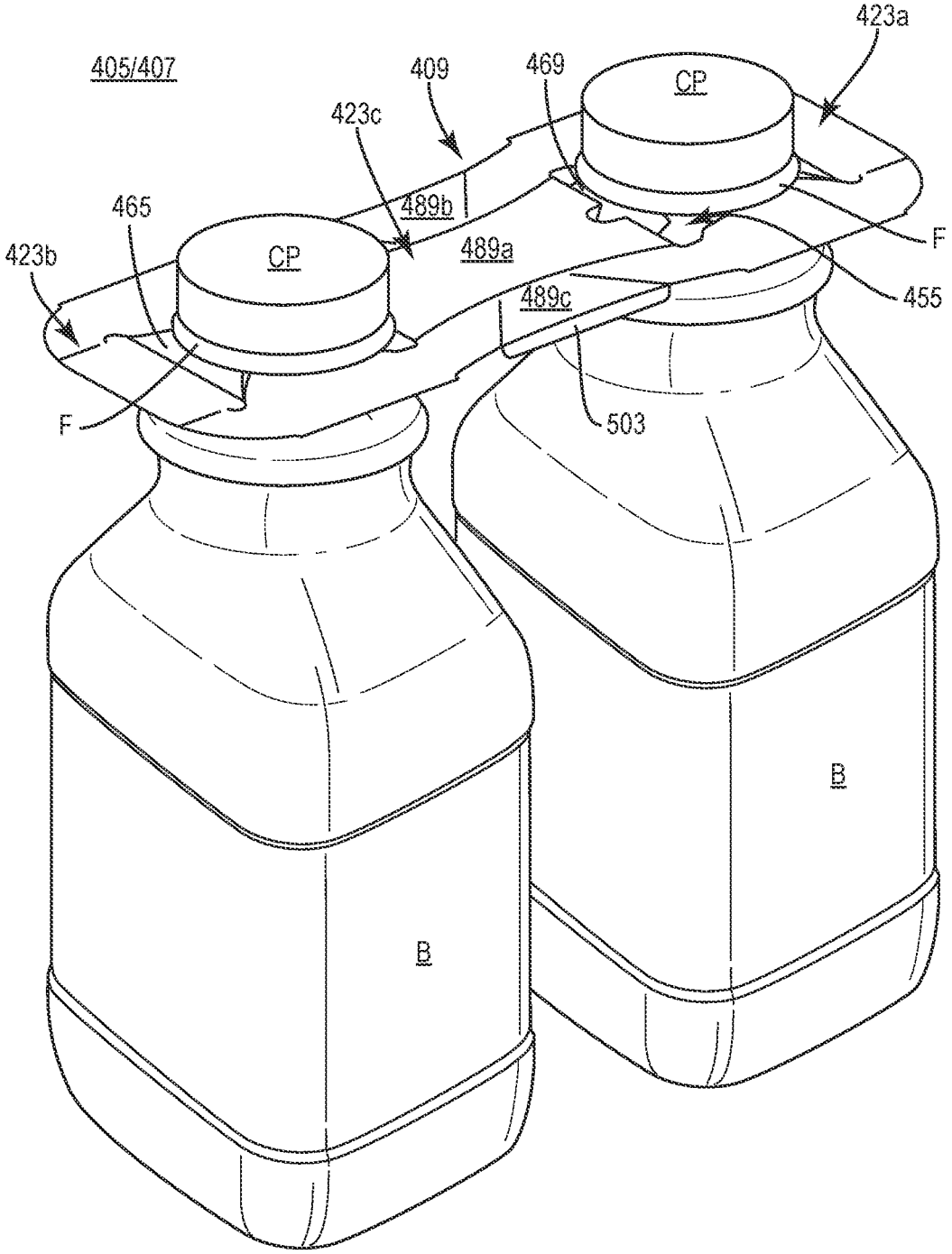
FIG. 8 is a perspective view of a carrier formed from the blank of FIG. 7 according to the third exemplary embodiment of the disclosure.

Turning to FIG. 8, according to one embodiment, the first panel 421 can be folded at the fold line 425 into at least partial face-to-face contact with the second panel 423. In particular, an interior surface of the first panel 421 (e.g., a surface opposite the exterior surface 401 of the blank 403) can be positioned in at least partial face-to-face contact with the interior surface of the second panel 423.

Thereafter, the third panel 431 can be folded at the fold line 433 such that the interior surface of the third panel 431 is positioned in at least partial face-to-face contact with the exterior surface of the first panel 421.

In such an arrangement, the second panel 423 is positioned with an exterior surface thereof facing upwardly and an interior surface thereof facing downwardly and in at least partial face-to-face contact with the interior surface of the first panel 421, the exterior surface of the first panel 421 is positioned facing downwardly and in at least partial face-to-face contact with the interior surface of the third panel 431, and the exterior surface of the third panel 431 is positioned facing downwardly. In this regard, the first panel 421 is positioned between the second panel 423 and the third panel 431.

The aforementioned construction of the carrier 405 can be at least partially maintained with at least one or more applications of an adhesive such as glue. In some embodiments, an adhesive such as glue can be applied to respective portions of the interior surface of the panel 421 and to respective portions of the interior surface of the panel 431.

Such an arrangement provides a reinforced, multi-ply (e.g., three-ply) arrangement of the panels of the carrier 405 that affords a robust construction and resistance to tearing or other damage as compared to, for example, a carrier construction that lacks such an arrangement of multiple plies.

In addition, the respective container retention openings 451, 455 on respective lateral end portions of the panels 421, 423, 431 can be arranged in general alignment for at least partially receiving containers B, as described further below.

Furthermore, the handle portion 489 of the second panel 423 can be aligned above the handle portions 483, 495 of the panels 421, 431 therebelow, as well as the handle reinforcement flaps 501, 503 extending away therefrom, to provide the handle 409.

The carrier 405 can be positioned to at least partially receive/engage respective containers B. In some embodiments, at least the cap CP and/or flange portion F of a respective container B can be at least partially received through respective aligned container retention openings 451, 455 to form the package 407.

Such movement of portions of a respective container B through respective aligned container retention openings 451, 455 can cause respective container retention tabs 465, 469 to fold upwardly at respective portions of the respective fold lines 467, 471 such that the container retention tabs 465, 469 extend from the respective panels 423, 431 to the underside of the respective flange portion F of a respective container B, e.g., in a bracing/tightening relationship.

In some embodiments, the one or more portions of the respective container retention openings 451, 455, e.g., respective oblique portions of the respective cuts thereof, can at least partially engage, e.g., via compression and/or frictional/interfering engagement, a portion of a respective container B extending therethrough, e.g., a respective neck portion N thereof, in order to enhance engagement of the carrier 405 and the respective containers B.

Figure 9:
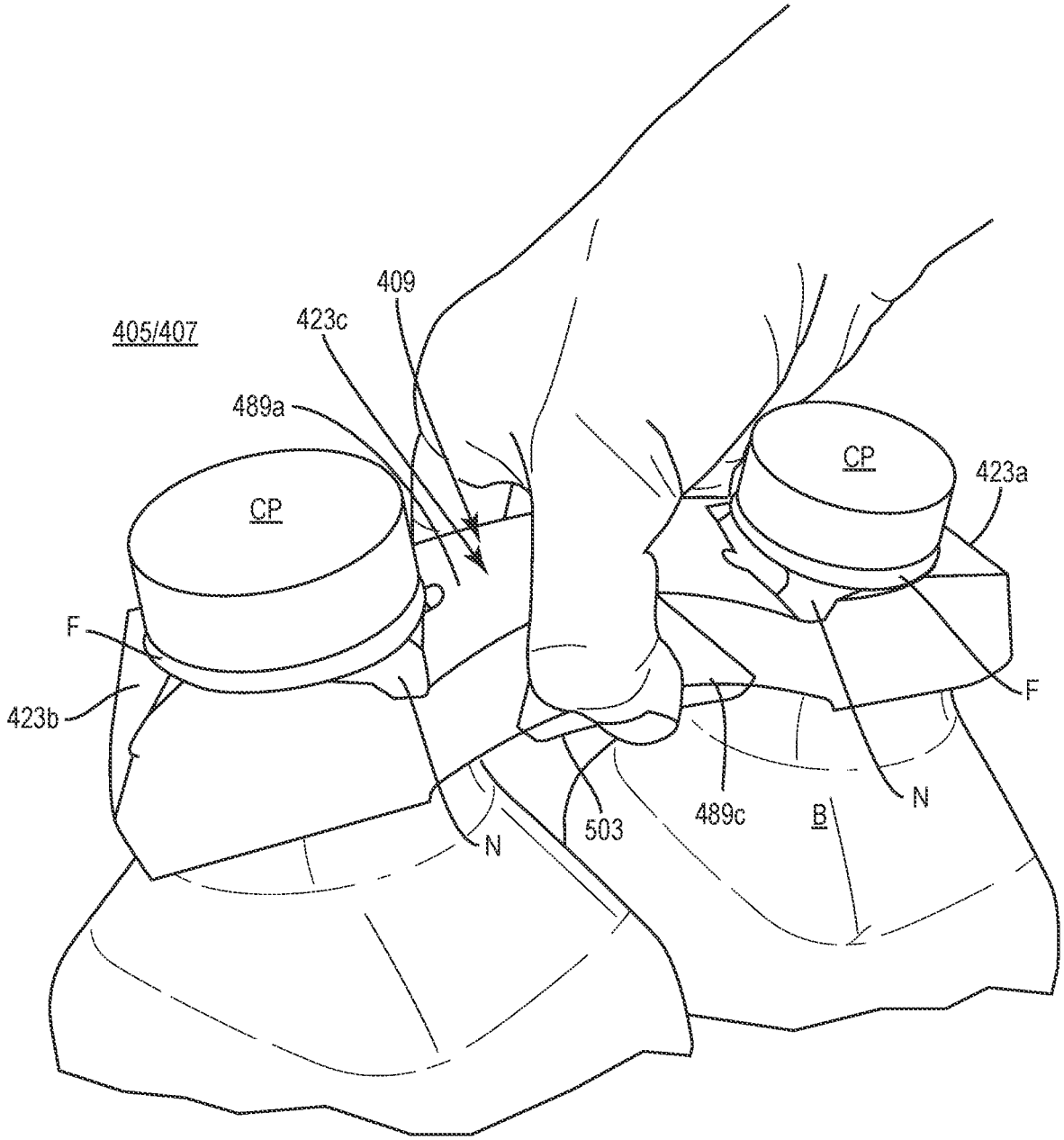
FIG. 9 is a perspective view of a portion of the carrier of FIG. 8 being lifted by a user.

With additional reference to FIG. 9, in order to lift and/or carry the package 407/carrier 405, a user can grasp the handle 409, for example, by at least partially curling his or her hand/fingers around the handle portions 483, 489, 495 of the respective panels 421, 423, 431. Such engagement of the package 407/carrier 405 by the user can cause the handle reinforcement flaps 501, 503 to fold at least partially downwardly at the respective fold lines 505, 507 so as to be positioned between the user's hand and the remainder of the handle 509.

In this regard, in some embodiments, the handle reinforcement flaps 501, 503 can provide an additional two plies of material between a user's hand and the aligned panels 423, 421, 431, for example, for comfort and/or grip strength, to avoid tearing or other unwanted damage of the package 407/carrier 405, etc.

Furthermore, the respective reconfigurable features can cause, via relative movement of one or more portions of the respective panels 421, 423, 431 at one or more of the respective reconfigurable portions 533, 535, 537, 539, 541, 543, 545, 547, 549, 551, 553, 555, 557, 559, 561, 563, 565, 567 at the respective oblique lines of weakening 509, 511, 513, 515, 517, 519, 529, 531 can cause at least partial reconfiguration of the carrier 405/package 407, e.g., to relieve stresses transmitted along the carrier package 405/package 407 due to lifting and/or carrying the carrier 405/package 407 and/or due to engagement with the containers B.

In the illustrated embodiment, the lines of weakening 509, 511, 513, 515, 517, 519, 529, 531 can facilitate movement of the aligned end portions 421*a*, 423*a*, 431*a* and aligned end portions 421*b*, 423*a*, 431*c* of the respective panels 421, 423, 431 to raise at least partially upwardly and/or downwardly relative to the respective aligned central portions 421*c*, 423*c*, 431*c* of the respective panels 421, 423, 431.

Furthermore, during the course of lifting and/or carrying the package 407/carrier 405 by a user, the lines of weakening 509, 511, 513, 515, 517, 519, 529, 531 can facilitate relative movement and/or curving of the handle 409, for example, to facilitate a comfortable grip and/or beneficial distribution of stresses across portions of the handle 409 during use. In some embodiments, one or more of the relief cuts 445, 447 can facilitate planar flexion of the respective panels 421, 423, 431, for example, relative to a plane defined by the axes L1, L2, to provide relief to stresses associated with the engagement of the containers B at least partially received through the respective container retention openings 451, 455.

In this regard, the handle 409 of the package 407/carrier 405 and associated features can be positioned between the container retention features of the package 407/carrier 405 such that a symmetrically and conveniently positioned handle 409 is provided between portions of the package 407/carrier 405 that support the containers B, with advantages similar to those described above with respect to the carriers 105, 205 and packages 107, 207.

Figure 10:
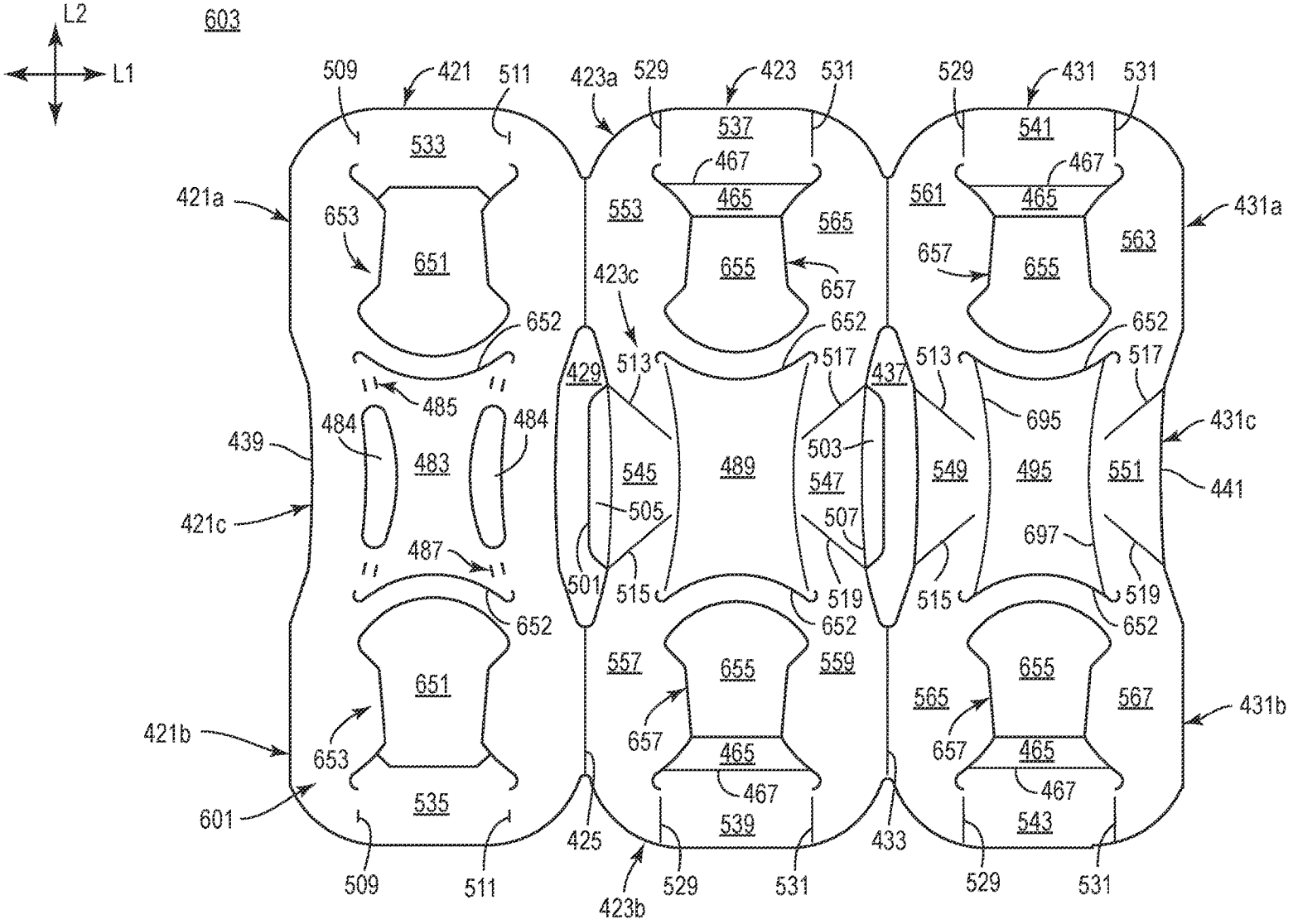
FIG. 10 is a plan view of an exterior surface of a blank for forming a carrier for containers according to a fourth exemplary embodiment of the disclosure.
Figure 10A:
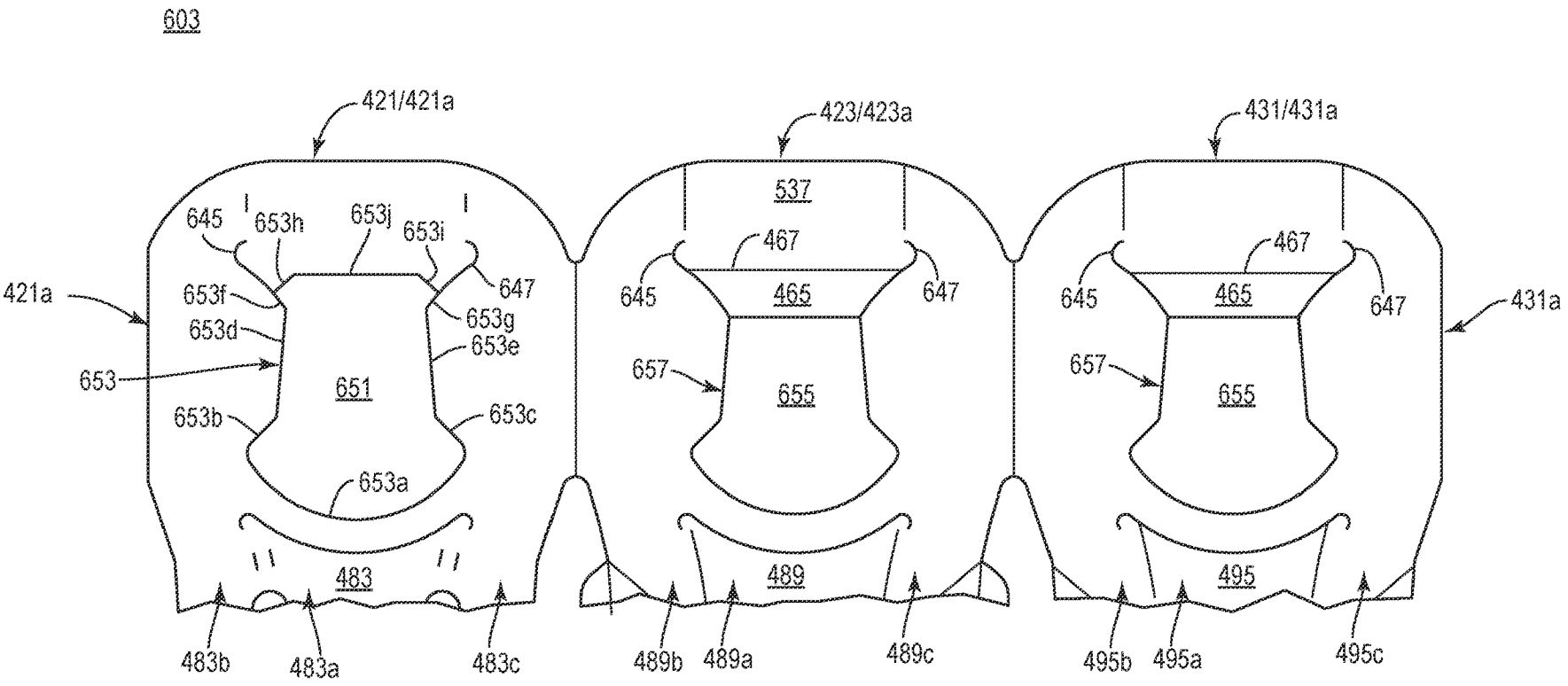
FIG. 10A is an enlarged view of a portion of the blank of FIG. 10.

Turning to FIGS. 10 and 10A, a plan view of an exterior surface 601 of a blank 603 for forming a carrier 605 is illustrated according to a fourth exemplary embodiment of the disclosure. The blank 603 and carrier 605 formed therefrom can have one or more features that are the same or similar to those of the respective blanks 103, 203, 403 and carriers 105, 205, 405 described above, and like or similar features are described with like or similar reference numerals. The carrier 605 can be provided with one or more containers B as a package 607.

The blank 603 and the carrier 605 formed therefrom can have a configuration that is generally similar to that of the blank 403 and carrier 405 formed therefrom as described above, except that the blank 403/carrier 405 can be devoid of the container retention tabs 469 and openings 481. Furthermore, the handle portion 495*a* of the third panel 431 can be at least partially defined between a single pair of curved fold lines 697, 699.

Further still, the blank 603/carrier 605 can be provided with a pair of container retention openings 651 (broadly respective "first container retention opening" and "second container retention opening") in the first panel 421, and a pair of container retention openings 655 (broadly respective "first container retention opening" and "second container retention opening") in each of the second panel 423 and the third panel 431.

In addition, respective curved lines of weakening or curved fold lines 652 can be positioned spaced apart from each respective container retention openings 651, 655 toward a respective handle portion 483, 489, 495 of a respective panel 421, 423, 431.

Each container retention opening 651, as shown, can be at least partially defined by a respective cut 653 having a generally curved lower segment 653*a*, a pair of generally oblique segments 653*b*, 653*c* extending upwardly and inwardly from endpoints of the segment 653*a*, a pair of generally oblique segments 653*d*, 653*e* extending upwardly and inwardly from respective endpoints of the segments 653*b*, 653*c*, a pair of further generally oblique segments 653*f*, 653*g* extending upwardly and outwardly from respective endpoints of the respective segments 653*d*, 653*e*, a pair of generally oblique segments 653*h*, 653*i* extending upwardly and inwardly from respective endpoints of the respective segments 653*f*, 653*g*, and a generally longitudinal upper segment 653*j* extending from an endpoint of the segment 653*h* to an endpoint of the segment 653*i*.

A pair of generally J-shaped relief cuts 645, 647 can extend away from respective endpoints of the oblique segments 653*f*, 653*g* of the cut 653.

Each opening 655 in the panels 423, 431 can be at least partially defined by a cut 657 that can be generally similar to the cuts 653 described above, though devoid of the segments 653*f*, 653*g*, 653*h*, 653*i*, 653*j*.

Figure 11:
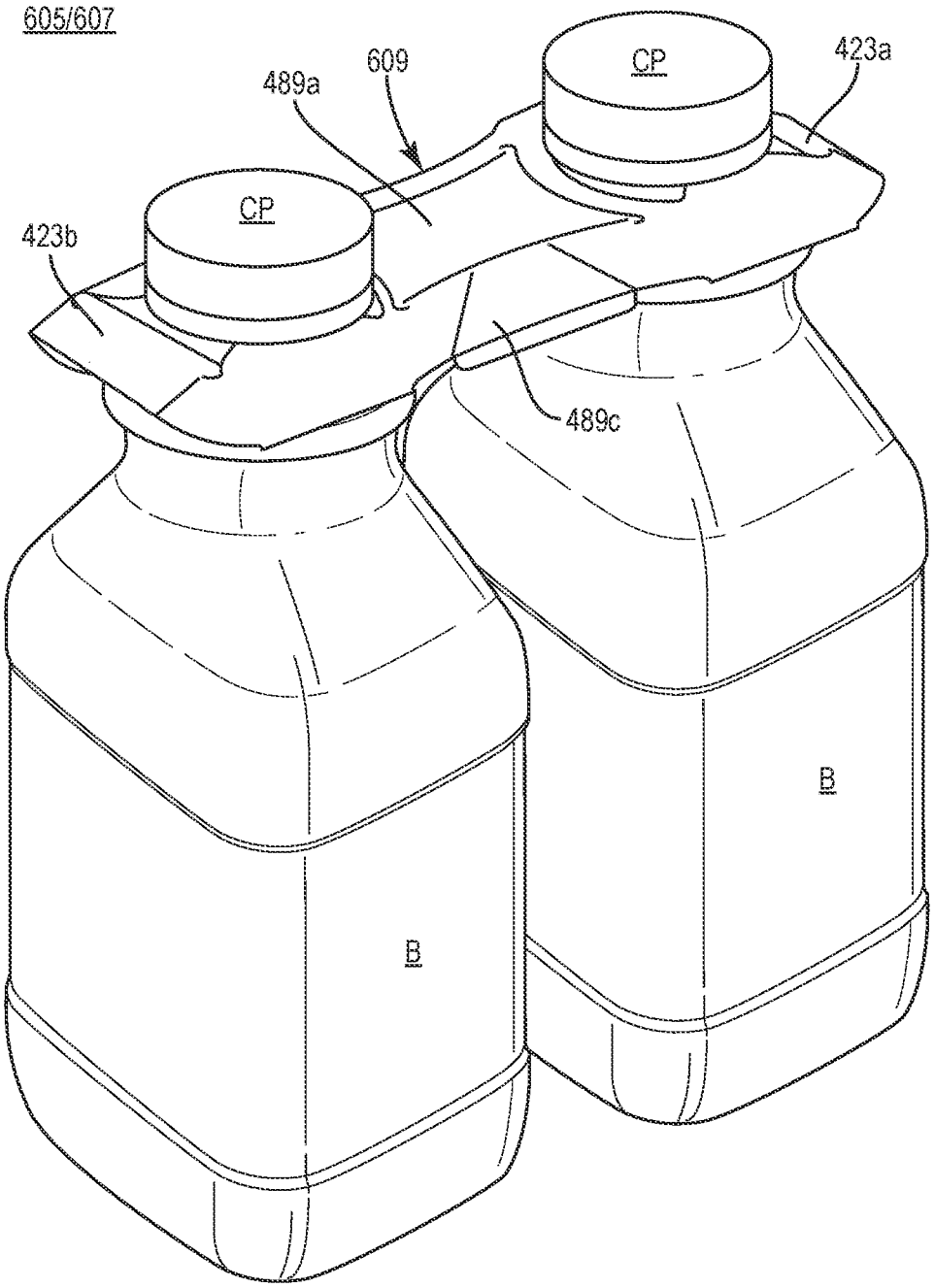
FIG. 11 is a perspective view of a carrier formed from the blank of FIG. 10 according to the fourth exemplary embodiment of the disclosure.
Figure 12:
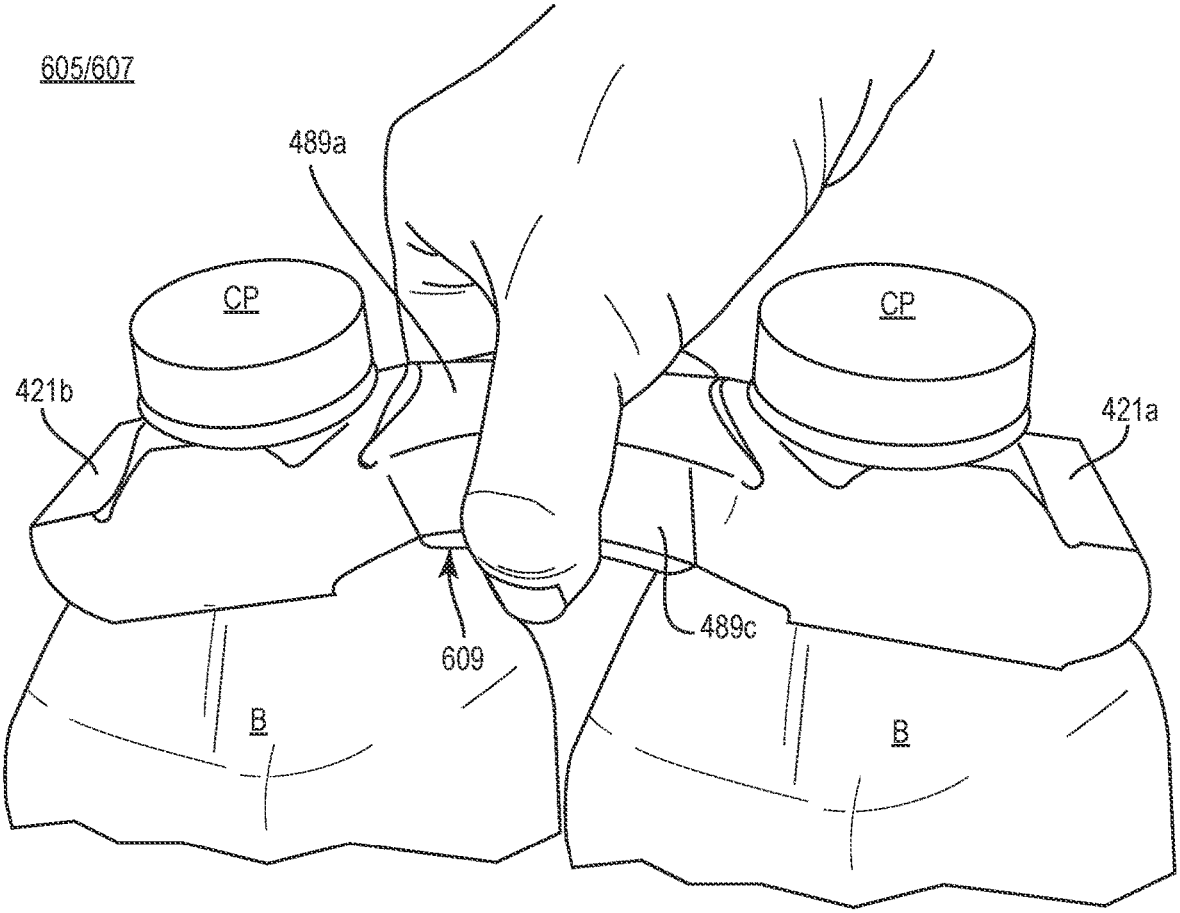
FIG. 12 is a perspective view of a portion of the carrier of FIG. 11 being lifted by a user.

With additional reference to FIGS. 11 and 12, the carrier 605 having a handle 609 can be formed from the blank 603 in a manner generally similar to that described above with respect to the formation of the carrier 405 from the blank 403, and can be engaged with one or more of the containers B to form the package 607 having an arrangement and advantages similar to that described above with respect to the carrier 405 and package 407.

Figure 13:
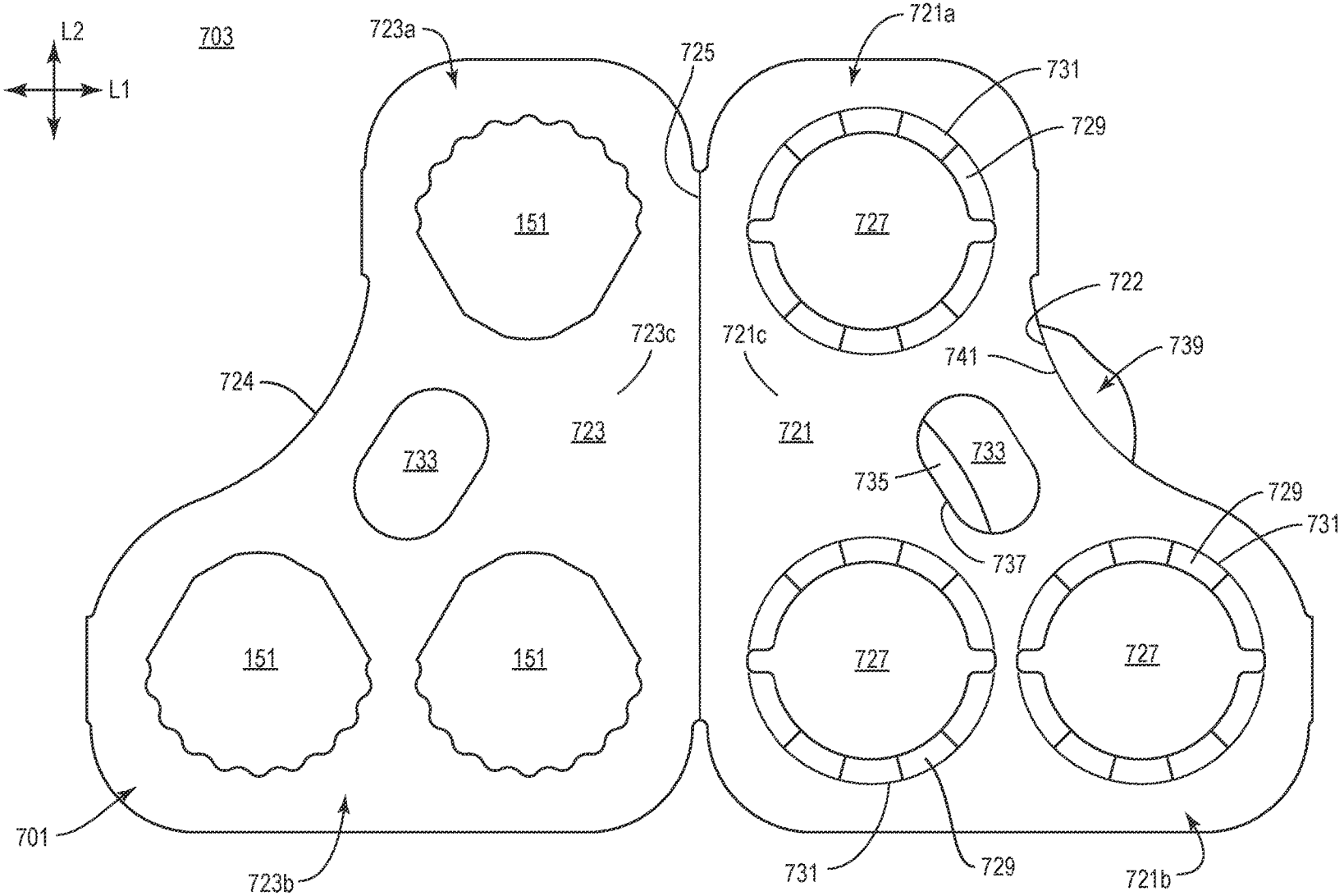
FIG. 13 is a plan view of an exterior surface of a blank for forming a carrier for containers according to a fifth exemplary embodiment of the disclosure.

Turning to FIG. 13, a plan view of an exterior surface 701 of a blank 703 for forming a carrier 705 is illustrated according to a fifth exemplary embodiment of the disclosure. The blank 703 and carrier 705 formed therefrom can have one or more features that are the same or similar to those of the respective blanks 103, 203, 403, 603 and carriers 105, 205, 405, 605 described above, and like or similar features are described with like or similar reference numerals. The carrier 705 can be provided with one or more containers B as a package 707.

The blank 703 and the carrier 705, as shown, can have the longitudinal axis L1 and the lateral axis L2 and a plurality of panels that can include an upper panel or first panel 721 foldably connected to a lower panel or second panel 723 at a lateral fold line 725. As shown, each of the first panel 721 and the second panel 723 can have a generally delta-shaped configuration, with a respective curved free edge 722, 724 positioned between a respective first end portion 721*a*, 723*a* thereof and a respective second end portion 721*b*, 723*b* thereof. As also shown, a central portion 721*c* extends from the first end portion 721*a* to the second end portion 721*b*, and a central portion 723*c* extends from the first end portion 723*a* to the second end portion 723*b*.

The blank 703 and carrier 705 formed therefrom can include a plurality of container retention features for at least partially receiving one or more containers of the plurality of containers B. In the illustrated embodiment, the first panel 721 can include a plurality of container retention openings 727 having a generally circular configuration, and with a plurality of container retention tabs 729 foldably connected to the first panel 721 at a respective curved fold line 731 and positioned extending into the respective container retention opening 727. As shown, one or more of the container retention tabs 729 can be larger than an adjacent container retention tab 729, through the container retention tabs 729 can have a uniform configuration without departing from the disclosure. In the illustrated embodiment, a first container retention opening 727 can be positioned in the first end portion 721*a* of the first panel 721, and a second container retention opening 727 and third container retention opening 727 can be positioned in the second end portion 721*b* of the first panel 721, though a different arrangement of container retention openings can be provided without departing from the disclosure.

A plurality of the container retention openings 151 can be at least partially defined in portions of the second panel 723 and for at least partially receiving a respective container of the plurality of containers B when the carrier 705 is formed from the blank 703, as described further herein. In the illustrated embodiment, a first container retention opening 151 can be positioned in the first end portion 723*a* of the second panel 723, and a second container retention opening 151 and third container retention opening 151 can be positioned in the second end portion 723*b* of the second panel 723, though a different arrangement of container retention openings can be provided without departing from the disclosure.

The blank 703 and the carrier 705 formed therefrom can also include a plurality of handle features for forming a handle 709 of the carrier 705. In the illustrated embodiment, the handle features can include a respective oblique handle opening 733 positioned in each of the first panel 721 and the second panel 723 (broadly, "first handle opening" and "second handle opening", respectively). As shown, a handle reinforcement flap 735 (broadly, "second handle reinforcement flap") can be foldably connected to the first panel 721 at an oblique fold line 737 and positioned extending into the respective opening 733.

As also shown, a handle reinforcement flap 739 (broadly, "first handle reinforcement flap") can be foldably connected to the first panel 721 at a curved fold line 741 along a portion of the free edge 722.

Figure 14:
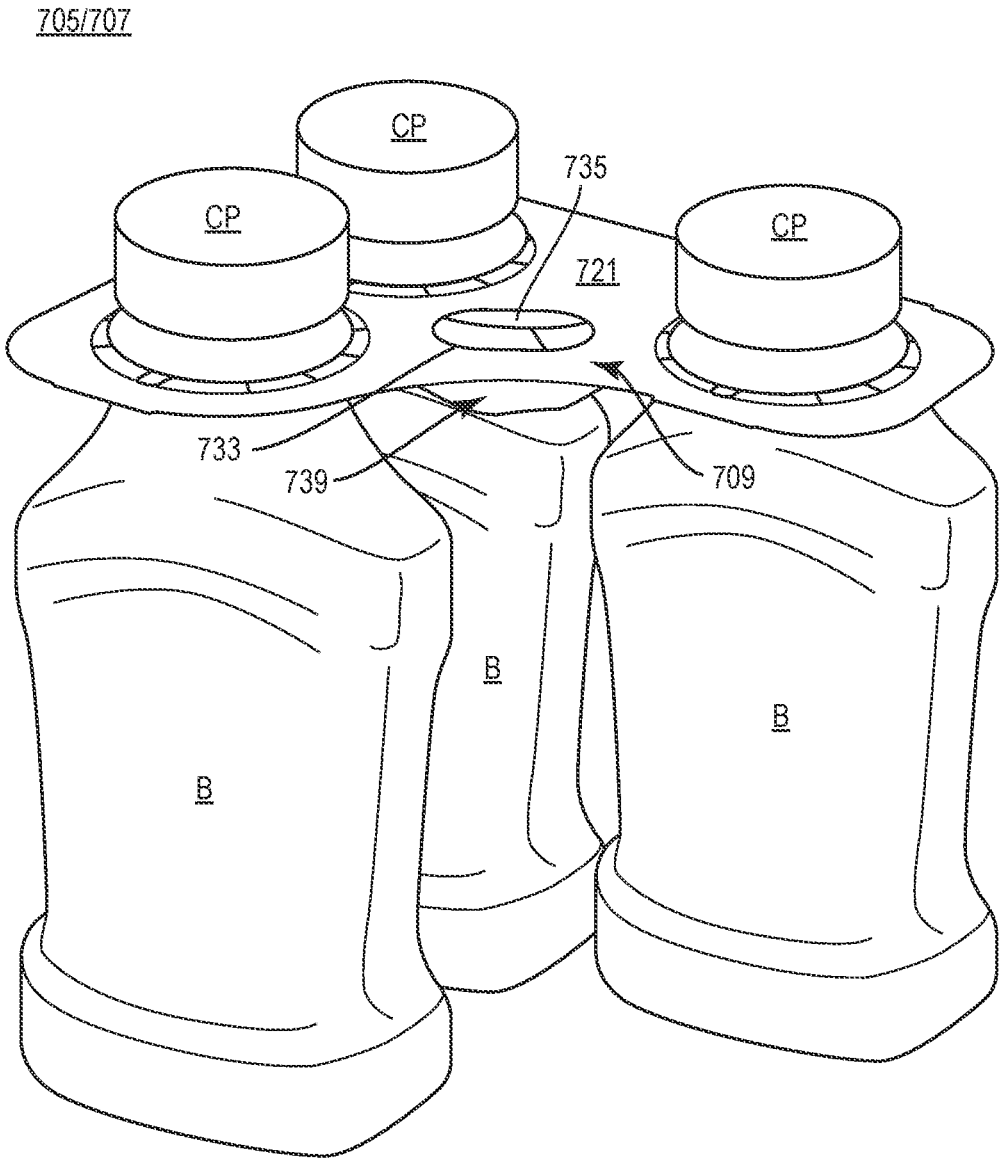
FIG. 14 is a perspective view of a carrier formed from the blank of FIG. 13 according to the fifth exemplary embodiment of the disclosure.

Turning to FIG. 14, according to one exemplary embodiment, to form the carrier 705 from the blank 703, the first panel 721 can be folded into at least partial face-to-face contact with the second panel 723 at the fold line 725 such that an interior surface (e.g., opposite the exterior surface 701) of the first panel 721 contacts the interior surface of the second panel 723.

In such an arrangement, the container retention openings 727 can be positioned in alignment above the respective container retention openings 151, and the handle openings 733 can be positioned in alignment with one another. In this regard, the handle 709 of the carrier 705 can be at least partially defined between the aligned handle openings 733 and the aligned curved free edges 722, 724 of the respective panels 721, 723.

In order to form the package 707, the carrier 705 can be positioned to at least partially receive/engage respective containers B. In some embodiments, at least the cap CP and/or flange portion F of a respective container B can be at least partially received through respective aligned container retention openings 727, 151 to form the package 707.

Such movement of portions of a respective container B through respective aligned container retention openings 727, 151 can cause respective container retention tabs 729 to fold upwardly at respective portions of the respective fold lines 731 such that the container retention tabs 729 extend from the respective panels 721, 723 to the underside of the respective flange portion F of a respective container B, e.g., in a bracing/tightening relationship.

In some embodiments, the oblique 153*a*, 153*b* and/or curved 153*c* segments of the respective container retention openings 151 can at least partially engage, e.g., via compression and/or frictional/interfering engagement, a portion of a respective container B extending therethrough, e.g., a respective neck portion N thereof, in order to enhance engagement of the carrier 705 and the respective containers B.

Figure 15:
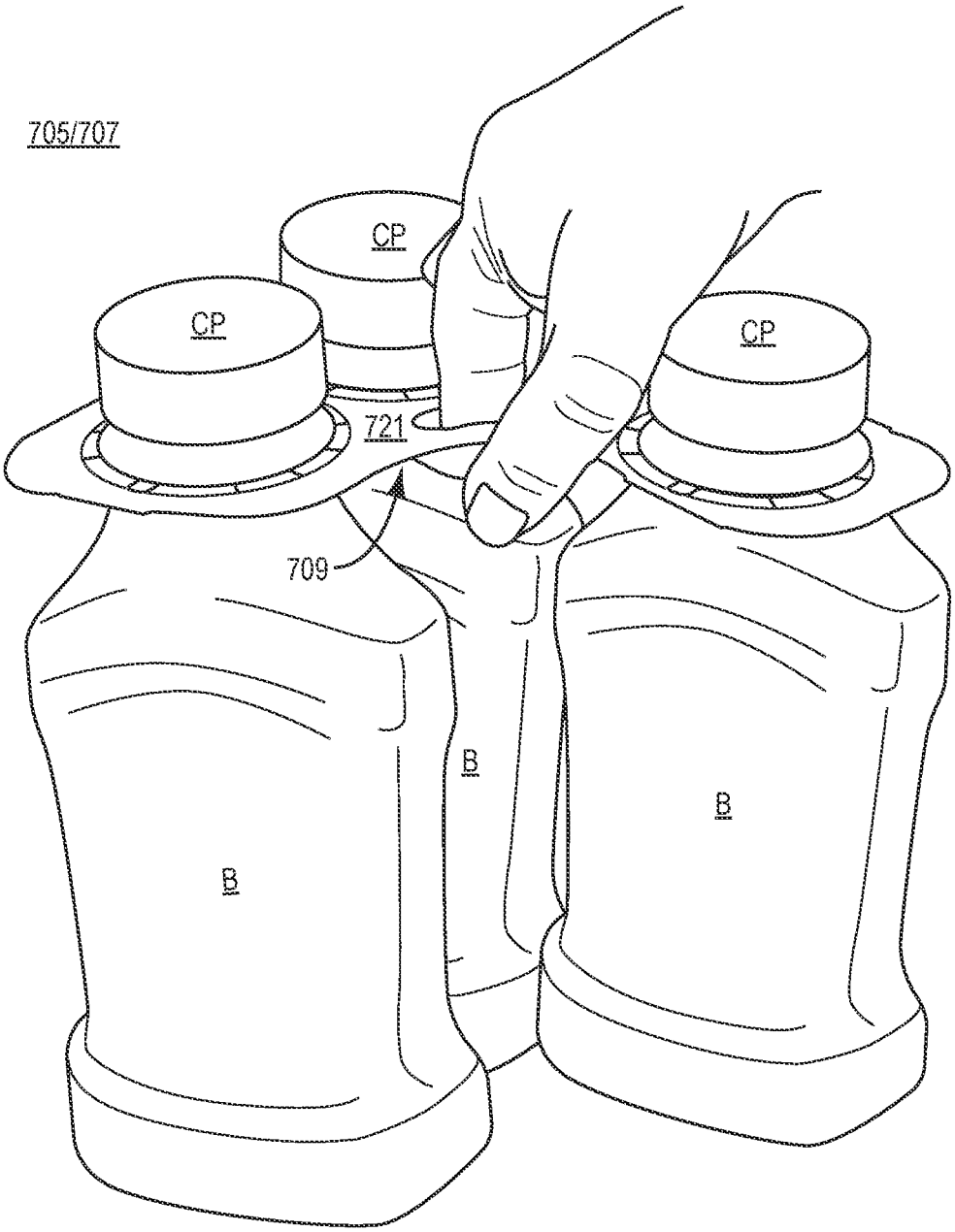
FIG. 15 is a perspective view of a portion of the carrier of FIG. 14 being lifted by a user.

With additional reference to FIG. 15, in order to grasp the package 707/carrier 705, a user can insert one or more of his or her fingers through the aligned handle openings 733 to contact an underside of the package 707/carrier 705, e.g., along an exterior surface of the second panel 723.

Such movement can cause the handle reinforcement flap 735 to fold downwardly at the fold line 737 and through the aligned openings 733. In some embodiments, the handle reinforcement flap 735 can be positioned between one or more of a user's fingers and the second panel 723, for example, for strength (e.g., by providing an extra ply of material in addition to that provided by the first panel 721 and the second panel 723), for comfort (e.g., to avoid pinching), etc.

Furthermore, such grasping of the handle 709 by the user can cause the handle reinforcement flap 739 to fold at least partially downwardly at the fold line 741, for example, incidental to contact with the web between a user's thumb and forefinger. In some embodiments, the handle reinforcement flap 739 can be positioned between a portion of the user's hand and the second panel 723, for example, for strength (e.g., by providing an extra ply of material in addition to that provided by the first panel 721 and the second panel 723), for comfort (e.g., to avoid pinching), etc.

The blank 703 and the carrier 705/package 707 formed therefrom can thus provide a convenient structure by which a user can grasp a plurality of containers B comfortably and through an arrangement reinforced by the multiple plies of material provided by the panels 721, 723.

In general, the blank may be constructed from paperboard having a caliper so that it is heavier and more rigid than ordinary paper. The blank can also be constructed of other materials, such as cardboard, or any other material having properties suitable for enabling the carrier to function at least generally as described above. The blank can be coated with, for example, a clay coating. The clay coating may then be printed over with product, advertising, and other information or images. The blanks may then be coated with a varnish to protect information printed on the blanks. The blanks may also be coated with, for example, a moisture barrier layer, on either or both sides of the blanks. The blanks can also be laminated to or coated with one or more sheet-like materials at selected panels or panel sections.

As an example, a tear line can include: a slit that extends partially into the material along the desired line of weakness, and/or a series of spaced apart slits that extend partially into and/or completely through the material along the desired line of weakness, or various combinations of these features. As a more specific example, one type of tear line is in the form of a series of spaced apart slits that extend completely through the material, with adjacent slits being spaced apart slightly so that a nick (e.g., a small somewhat bridging-like piece of the material) is defined between the adjacent slits for typically temporarily connecting the material across the tear line. The nicks are broken during tearing along the tear line. The nicks typically are a relatively small percentage of the tear line, and alternatively the nicks can be omitted from or torn in a tear line such that the tear line is a continuous cut line. That is, it is within the scope of the present disclosure for each of the tear lines to be replaced with a continuous slit, or the like. For example, a cut line can be a continuous slit or could be wider than a slit without departing from the present disclosure.

In accordance with the exemplary embodiments, a fold line can be any substantially linear, although not necessarily straight, form of weakening that facilitates folding therealong. More specifically, but not for the purpose of narrowing the scope of the present disclosure, fold lines include: a score line, such as lines formed with a blunt scoring knife, or the like, which creates a crushed or depressed portion in the material along the desired line of weakness; a cut that extends partially into a material along the desired line of weakness, and/or a series of cuts that extend partially into and/or completely through the material along the desired line of weakness; and various combinations of these features. In situations where cutting is used to create a fold line, typically the cutting will not be overly extensive in a manner that might cause a reasonable user to incorrectly consider the fold line to be a tear line.

The above embodiments may be described as having one or more panels adhered together by glue during erection of the carrier embodiments. The term "glue" is intended to encompass all manner of adhesives commonly used to secure carrier panels in place.

The foregoing description of the disclosure illustrates and describes various exemplary embodiments. Various additions, modifications, changes, etc., could be made to the exemplary embodiments without departing from the spirit and scope of the disclosure. It is intended that all matter contained in the above description or shown in the accompanying drawings shall be interpreted as illustrative and not in a limiting sense. Additionally, the disclosure shows and describes only selected embodiments of the disclosure, but the disclosure is capable of use in various other combinations, modifications, and environments and is capable of changes or modifications within the scope of the inventive concept as expressed herein, commensurate with the above teachings, and/or within the skill or knowledge of the relevant art. Furthermore, certain features and characteristics of each embodiment may be selectively interchanged and applied to other illustrated and non-illustrated embodiments of the disclosure.

What is claimed is:

1. A carrier for holding a plurality of containers, the carrier comprising:

a plurality of panels comprising a first panel foldably connected to a second panel and a third panel foldably connected to the second panel, the first panel in at least partial face-to-face contact with the second panel, the third panel overlapping the first panel such that the first panel is positioned between the second panel and the third panel, each of the first panel and the second panel and the third panel comprising a first end portion, a second end portion, and a central portion extending from the first end portion to the second end portion;

container retention features comprising at least one container retention opening in each of the first panel and the second panel and the third panel, the at least one container opening in the first panel aligned with the at least one container retention opening in the second panel and the at least one container opening in the third panel for at least partially receiving a respective container of the plurality of containers; and a handle positioned between the first end portion and the second end portion of each of the first panel and the second panel and the third panel for being grasped by a user.

2. The carrier of claim 1, wherein the central portion of each of the first panel and the second panel and the third panel is narrower than each of the first end portion and the second end portion of each of the first panel and the second panel and the third panel.

3. The carrier of claim 2, wherein the container retention features comprise at least one container retention tab foldably connected to the second panel and positioned extending into the at least one container retention opening in the second panel.

4. The carrier of claim 3, wherein the at least one container retention opening in the second panel is a first container retention opening in the first end portion of the second panel for at least partially receiving a respective container of the plurality of containers, and the container retention features further comprise a second container retention opening in the second end portion of the second panel for at least partially receiving a respective container of the plurality of containers.

5. The carrier of claim 4, wherein the at least one container retention opening in the first panel is a first container retention opening in the first end portion of the first panel for at least partially receiving a respective container of the plurality of containers, and the container retention features further comprise a second container retention opening in the second end portion of the first panel for at least partially receiving a respective container of the plurality of containers, wherein at least a portion of an inner edge of each of the first container retention opening and the second container retention opening is sinusoidal.

6. The carrier of claim 3, wherein the container retention features further comprise at least one container retention tab foldably connected to the third panel and positioned extending into the at least one container retention opening in the third panel.

7. The carrier of claim 6, wherein the first panel is foldably connected to the second panel at a fold line interrupted by a first opening, and the third panel is foldably connected to the second panel at a fold line interrupted by a second opening, and the handle further comprises a first handle reinforcement flap foldably connected to the second panel and extending into the first opening, and a second handle reinforcement flap foldably connected to the second panel and extending into the second opening.

8. The carrier of claim 6, wherein the plurality of panels further comprises a fourth panel foldably connected to the third panel, the fourth panel in at least partial face-to-face contact with each of the first panel and the third panel such that the first panel and the fourth panel are positioned between the second panel and the third panel.

9. The carrier of claim 4, wherein the container retention features further comprise a third container retention opening in the second end portion of the first panel for at least partially receiving a respective container of the plurality of containers, and a third container retention opening in the second end portion of the second panel aligned with the third container retention opening in the first panel for at least partially receiving a respective container of the plurality of containers.

10. The carrier of claim 9, wherein the handle comprises a first handle opening in the central portion of the first panel and a second handle opening in the second panel aligned with the first handle opening.

11. The carrier of claim 10, wherein the handle further comprises a first handle reinforcement flap foldably connected to the first panel extending away from a free edge of the first panel.

12. The carrier of claim 11, wherein the handle further comprises a second handle reinforcement flap foldably connected to the first panel and positioned extending into the first handle opening.

13. A blank for forming a carrier for holding a plurality of containers, the blank comprising:

a plurality of panels comprising a first panel foldably connected to a second panel and a third panel foldably connected to the second panel, the first panel configured for being positioned in at least partial face-to face contact with the second panel when the carrier is formed from the blank, the third panel overlapping the first panel such that the first panel is positioned between the second panel and the third panel when the carrier is formed from the blank, each of the first panel and the second panel and the third panel comprising a first end portion, a second end portion, and a central portion extending from the first end portion to the second end portion;

container retention features comprising at least one container retention opening in each of the first panel and the second panel and the third panel, the at least one container opening in the first panel for being aligned with the at least one container retention opening in the second panel and the at least one container opening in the third panel configured for at least partially receiving a respective container of the plurality of containers when the carrier is formed from the blank; and a handle portion positioned between the first end portion and the second end portion of each of the first panel and the second panel and the third panel for forming a handle for being grasped by a user when the carrier is formed from the blank.

14. The blank of claim 13, wherein the central portion of each of the first panel and the second panel and the third panel is narrower than each of the first end portion and the second end portion of each of the first panel and the second panel and the third panel.

15. The blank of claim 14, wherein the container retention features comprise at least one container retention tab foldably connected to the second panel and positioned extending into the at least one container retention opening in the second panel.

16. The blank of claim 15, wherein the at least one container retention opening in the second panel is a first container retention opening in the first end portion of the second panel for at least partially receiving a respective container of the plurality of containers, and the container retention features further comprise a second container retention opening in the second end portion of the second panel for at least partially receiving a respective container of the plurality of containers when the carrier is formed from the blank.

17. The blank of claim 16, wherein the at least one container retention opening in the first panel is a first container retention opening in the first end portion of the first panel for at least partially receiving a respective container of the plurality of containers when the carrier is formed from the blank, and the container retention features further comprise a second container retention opening in the second end portion of the first panel for at least partially receiving a respective container of the plurality of containers when the carrier is formed from the blank, wherein at least a portion of an inner edge of each of the first container retention opening and the second container retention opening is sinusoidal.

18. The blank of claim 15, wherein the container retention features further comprise at least one container retention tab foldably connected to the third panel and positioned extending into the at least one container retention opening in the third panel.

19. The blank of claim 18, wherein the first panel is foldably connected to the second panel at a fold line interrupted by a first opening, and the third panel is foldably connected to the second panel at a fold line interrupted by a second opening, and the handle further comprises a first handle reinforcement flap foldably connected to the second panel and extending into the first opening, and a second handle reinforcement flap foldably connected to the second panel and extending into the second opening.

20. The blank of claim 18, wherein the plurality of panels further comprises a fourth panel foldably connected to the third panel, the fourth panel for being positioned in at least partial face to-face contact with each of the first panel and the third panel such that the first panel and the fourth panel are positioned between the second panel and the third panel when the carrier is formed from the blank.

21. The blank of claim 16, wherein the container retention features further comprise a third container retention opening in the second end portion of the first panel for at least partially receiving a respective container of the plurality of containers when the carrier is formed from the blank, and a third container retention opening in the second end portion of the second panel for being aligned with the third container retention opening in the first panel for at least partially receiving a respective container of the plurality of containers when the carrier is formed from the blank.

22. The blank of claim 21, wherein the handle comprises a first handle opening in the central portion of the first panel and a second handle opening in the second panel for being aligned with the first handle opening when the carrier is formed from the blank.

23. The blank of claim 22, wherein the handle further comprises a first handle reinforcement flap foldably connected to the first panel extending away from a free edge of the first panel.

24. The blank of claim 23, wherein the handle further comprises a second handle reinforcement flap foldably connected to the first panel and positioned extending into the first handle opening.

25. The carrier of claim 1, wherein the first panel is foldably connected to the second panel at a fold line interrupted by a first opening, and the third panel is foldably connected to the second panel at a fold line interrupted by a second opening, and the handle further comprises a first handle reinforcement flap foldably connected to the second panel and extending into the first opening, and a second handle reinforcement flap foldably connected to the second panel and extending into the second opening.

26. The carrier of claim 25, wherein the container retention features comprise a plurality of container retention tabs foldably connected to the second panel and positioned extending into the at least one container retention opening in the second panel, adjacent ones of the plurality of container retention tabs being partially separable from one another at an oblique cut.

27. The carrier of claim 26, wherein the container retention features further comprise a plurality of container retention tabs foldably connected to the third panel and positioned extending into the at least one container retention opening in the third panel, adjacent ones of the plurality of container retention tabs being partially separable from one another at an oblique cut.

28. The carrier of claim 25, wherein the plurality of panels further comprises a fourth panel foldably connected to the third panel, the fourth panel in at least partial face-to-face contact with each of the first panel and the third panel such that the first panel and the fourth panel are positioned between the second panel and the third panel.

29. The carrier of claim 1, wherein the plurality of panels further comprises a fourth panel foldably connected to the third panel, the fourth panel in at least partial face-to-face contact with each of the first panel and the third panel such that the first panel and the fourth panel are positioned between the second panel and the third panel.

30. The carrier of claim 29, wherein the container retention features comprise a plurality of container retention tabs foldably connected to the second panel and positioned extending into the at least one container retention opening in the second panel, adjacent ones of the plurality of container retention tabs being partially separable from one another at an oblique cut.

31. The carrier of claim 30, wherein the container retention features further comprise a plurality of container retention tabs foldably connected to the third panel and positioned extending into the at least one container retention opening in the third panel, adjacent ones of the plurality of container retention tabs being partially separable from one another at an oblique cut.

32. The carrier of claim 5, wherein the portion of the inner edge of the first container retention opening that is sinusoidal is aligned with the adjacent ones of the plurality of container retention tabs of the second container retention opening that are partially separable from one another at an oblique cut.

33. The blank of claim 13, wherein the first panel is foldably connected to the second panel at a fold line interrupted by a first opening, and the third panel is foldably connected to the second panel at a fold line interrupted by a second opening, and the handle further comprises a first handle reinforcement flap foldably connected to the second panel and extending into the first opening, and a second handle reinforcement flap foldably connected to the second panel and extending into the second opening.

34. The blank of claim 33, wherein the container retention features comprise a plurality of container retention tabs foldably connected to the second panel and positioned extending into the at least one container retention opening in the second panel, adjacent ones of the plurality of container retention tabs being partially separable from one another at an oblique cut.

35. The blank of claim 34, wherein the container retention features further comprise a plurality of container retention tabs foldably connected to the third panel and positioned extending into the at least one container retention opening in the third panel, adjacent ones of the plurality of container retention tabs being partially separable from one another at an oblique cut.

36. The blank of claim 33, wherein the plurality of panels further comprises a fourth panel foldably connected to the third panel, the fourth panel for being positioned in at least partial face to-face contact with each of the first panel and the third panel such that the first panel and the fourth panel are positioned between the second panel and the third panel when the carrier is formed from the blank.

37. The blank of claim 13, wherein the plurality of panels further comprises a fourth panel foldably connected to the third panel, the fourth panel for being positioned in at least partial face to-face contact with each of the first panel and the third panel such that the first panel and the fourth panel are positioned between the second panel and the third panel when the carrier is formed from the blank.

38. The blank of claim 37, wherein the first panel is foldably connected to the second panel at a fold line interrupted by a first opening, and the third panel is foldably connected to the second panel at a fold line interrupted by a second opening, and the handle further comprises a first handle reinforcement flap foldably connected to the second panel and extending into the first opening, and a second handle reinforcement flap foldably connected to the second panel and extending into the second opening.

39. The blank of claim 38, wherein the container retention features comprise a plurality of container retention tabs foldably connected to the second panel and positioned extending into the at least one container retention opening in the second panel, adjacent ones of the plurality of container retention tabs being partially separable from one another at an oblique cut.

40. The blank of claim 17, wherein the portion of the inner edge of the first container retention opening that is sinusoidal is aligned with the adjacent ones of the plurality of container retention tabs of the second container retention opening that are partially separable from one another at an oblique cut.

* * * * *